US011387030B2

(12) United States Patent
Rippel et al.

(10) Patent No.: US 11,387,030 B2
(45) **Date of Patent: *Jul. 12, 2022**

(54) FLUID COOLED MAGNETIC ELEMENT

(71) Applicant: PRIPPELL TECHNOLOGIES, LLC, Los Angeles, CA (US)

(72) Inventors: Eric E. Rippel, Los Angeles, CA (US); Wally E. Rippel, Altadena, CA (US)

(73) Assignee: Prippell Technologies, LLC, Los Angeles, CA (US)

( * ) Notice: Subject to any disclaimer, the term of this patent is extended or adjusted under 35 U.S.C. 154(b) by 214 days.

This patent is subject to a terminal disclaimer.

(21) Appl. No.: 16/022,463

(22) Filed: Jun. 28, 2018

(65) Prior Publication Data

US 2019/0006082 A1 Jan. 3, 2019

Related U.S. Application Data

(60) Provisional application No. 62/526,199, filed on Jun. 28, 2017.

(51) Int. Cl.
*H01F 27/08* (2006.01)
*H01F 27/24* (2006.01)
(Continued)

(52) U.S. Cl.
CPC ..... *H01F 27/08* (2013.01); *H01F 27/24* (2013.01); *H01F 27/2823* (2013.01);
(Continued)

(58) Field of Classification Search
CPC ..... H01F 27/02; H01F 27/025; H01F 27/08; H01F 27/10; H01F 27/105; H01F 27/12;
(Continued)

(56) References Cited

U.S. PATENT DOCUMENTS 2,865,086 A 12/1958 Whipple
2,987,684 A * 6/1961 Doucette, Jr. ..... H01F 27/2823 336/12
(Continued)

FOREIGN PATENT DOCUMENTS

CN 101473389 A 7/2009
CN 102265358 A 11/2011
(Continued)

OTHER PUBLICATIONS

International Search Report and Written Opinion of the International Searching Authority, dated Jul. 18, 2017, Corresponding to PCT/US2017/032559, 11 pages.
(Continued)

*Primary Examiner* — Tszfung J Chan
(74) *Attorney, Agent, or Firm* — Lewis Roca Rothgerber Christie LLP

(57) ABSTRACT

A fluid-cooled magnetic element. A plurality of coils is arranged in a non-toroidal configuration. Each coil may be a hollow cylinder, formed by winding a rectangular wire into a roll. The coils alternate with planer spacers. The coils may alternate in winding orientation, and the inner end of each coil may be connected, through a connection pin, to the inner end of an adjacent coil. Small gaps are formed between the coils and the spacers, e.g. as a result of each spacer having, on its two faces, a plurality of raised ribs, against which the coils abut. Cooling fluid flows through the gaps to cool the coils.

22 Claims, 20 Drawing Sheets

(51) Int. Cl.
*H01F 27/32* (2006.01)
*H01F 27/28* (2006.01)
*H01F 27/30* (2006.01)

(52) U.S. Cl.
CPC ..... *H01F 27/2847* (2013.01); *H01F 27/306* (2013.01); *H01F 27/32* (2013.01); *H01F 27/323* (2013.01); *H01F 27/2852* (2013.01)

(58) Field of Classification Search
CPC ..... H01F 27/125; H01F 27/16; H01F 27/20; H01F 27/24; H01F 27/263; H01F 27/2823; H01F 27/2847; H01F 27/2876; H01F 27/2895; H01F 27/30; H01F 27/306; H01F 27/32; H01F 27/322; H01F 27/323; H01F 27/324; H01F 6/04; H01F 17/06; H01F 17/062; H01F 2027/328
USPC .. 336/55, 57, 58, 60, 62, 90, 170, 178, 192, 336/199, 212, 229, 207
See application file for complete search history.

(56) References Cited

U.S. PATENT DOCUMENTS 3,028,566 A * 4/1962 Camilli ..... H01F 27/18 336/57
4,173,746 A * 11/1979 Stubblefield ..... H01F 27/322 336/57
4,679,020 A * 7/1987 Kawamura ..... H01F 6/06 29/599
4,763,072 A 8/1988 Katoh et al.
4,847,583 A 7/1989 Bernard
5,073,734 A * 12/1991 Combette ..... H02K 3/24 310/65
5,130,687 A * 7/1992 Evrard ..... H01F 6/00 335/216
5,334,899 A 8/1994 Skybyk
5,710,466 A * 1/1998 Allen ..... F04D 13/06 310/40 MM
RE36,787 E * 7/2000 Hansen ..... B29C 65/3668 219/632
6,211,595 B1 4/2001 Nose
6,273,022 B1 8/2001 Pu et al.
6,300,857 B1 10/2001 Herwig
6,720,688 B1 4/2004 Schiller
6,879,237 B1 4/2005 Viarouge et al.
7,710,228 B2 5/2010 Feng et al.
9,496,085 B2 11/2016 Pal et al.
9,911,525 B2 3/2018 Stelzer et al.
2004/0182517 A1 9/2004 Lai et al.
2006/0044104 A1 3/2006 Derks
2007/0090916 A1* 4/2007 Rao ..... H01F 17/062 336/229
2009/0140829 A1 6/2009 Sodo
2009/0261933 A1* 10/2009 Kiuchi ..... H01F 27/12 336/57
2010/0007225 A1 1/2010 Platon et al.
2011/0205007 A1* 8/2011 Kiuchi ..... H01F 27/2876 336/94
2011/0273256 A1 11/2011 Johnson et al.
2012/0153718 A1* 6/2012 Rawlinson ..... B60L 15/007 307/10.1
2013/0099887 A1* 4/2013 Yamamoto ..... H01F 30/06 336/220
2013/0257574 A1 10/2013 Downing et al.
2013/0278369 A1 10/2013 Shepard et al.
2014/0159846 A1 6/2014 Krämer et al.
2014/0292456 A1* 10/2014 Suzuki ..... H01F 27/263 336/55
2015/0042437 A1 2/2015 White
2015/0097644 A1 4/2015 Shepard et al.
2015/0213944 A1* 7/2015 Kuroda ..... H01F 27/255 336/212
2015/0221430 A1* 8/2015 Li ..... H01F 27/292 336/192
2015/0228399 A1 8/2015 Yoshimori et al.
2016/0005521 A1 1/2016 Pal
2016/0181000 A1 6/2016 Yen et al.
2017/0110238 A1 4/2017 Daily et al.
2017/0330670 A1 11/2017 Rippel et al.
2018/0157279 A1* 6/2018 Ganowsky ..... G05D 7/0635
2019/0088399 A1 3/2019 Rippel et al.
2020/0082968 A1 3/2020 Rippel et al.

FOREIGN PATENT DOCUMENTS

CN 103578715 A 2/2014
CN 104603893 A 5/2015
CN 105103409 A 11/2015
CN 106662408 A 5/2017
CN 109155180 A 1/2019
JP 59046015 A * 3/1984 ..... H01F 41/127
JP 60-33082 A 2/1985
JP 60033082 A * 2/1985
JP 6-251956 A 9/1994
JP 2004055802 A * 2/2004
KR 10-2013-0111922 A 10/2013

OTHER PUBLICATIONS

Chinese Notification of the First Office Action, for Patent Application No. 201780029677.X, dated Jan. 3, 2020, 8 pages.
Japanese Notification of Reasons for Rejection, for Patent Application No. JP 2018-559702, dated Oct. 29, 2019, 6 pages.
Partial English translation of the Chinese Notification of the First Office Action, for Patent Application No. 201780029677.X, dated Jan. 3, 2020, 11 pages.
Partial English translation of the Japanese Notification of Reasons for Rejection, for Patent Application No. JP 2018-559702, dated Oct. 29, 2019, 13 pages.
U.S. Office Action from U.S. Appl. No. 15/594,521, dated Mar. 5, 2019, 15 pages.
Chinese Notification of the Second Office Action, for Patent Application No. 201780029677.X, dated Oct. 29, 2020, 3 pages.
Partial English translation of the Chinese Notification of the Second Office Action, for Patent Application No. 201780029677.X, dated Oct. 29, 2020, 6 pages.
International Search Report and Written Opinion of the International Searching Authority, dated Sep. 13, 2018, Corresponding to PCT/US2018/040059, 10 pages.
Chinese Notification of the Third Office Action, for Patent Application No. 201780029677.X, dated Jul. 28, 2021, 13 pages.
Partial English translation of the Chinese Notification of the Third Office Action, for Patent Application No. 201780029677.X, dated Jul. 28, 2021,22 pages.
U.S. Office Action from U.S. Appl. No. 16/194,235, dated Feb. 22, 2021, 16 pages.
U.S. Office Action from U.S. Appl. No. 16/194,235, dated Sep. 20, 2021, 17 pages.
Chinese Notification of the First Office Action, for Patent Application No. 201880043770.0, dated May 7, 2022, 7 pages.
Partial English translation of the Chinese Notification of the First Office Action, for Patent Application No. 201880043770.0, dated May 7, 2022, 11 pages.

* cited by examiner

FLUID COOLED MAGNETIC ELEMENT

CROSS-REFERENCE TO RELATED APPLICATION(S)

The present application claims priority to and the benefit of U.S. Provisional Application No. 62/526,199, filed Jun. 28, 2017, entitled "LIQUID-COOLED NON-TOROIDAL MAGNETIC ELEMENT", the entire content of which is incorporated herein by reference.

The present application is related to U.S. patent application Ser. No. 15/594,521, filed May 12, 2017, entitled "LIQUID COOLED MAGNETIC ELEMENT", the entire content of which is incorporated herein by reference.

FIELD

One or more aspects of embodiments according to the present disclosure relate to magnetic elements, and more particularly to fluid cooled magnetic elements.

BACKGROUND

Magnetic elements such as transformers and inductors serve important functions in various power processing systems. In order to minimize their size and cost, current densities and electrical frequencies may be made as high as possible. However since conductor heat generation is proportionate to the square of current density, and core heat generation is approximately proportionate to the square of the frequency, it follows that efficient heat transfer is important. The end result is that power density for magnetic elements is in effect limited by heat transfer. In such a system, it may be advantageous to arrange for efficient heat transfer from the winding and core and also for low eddy losses—both within the winding and the core.

Thus, there is a need for magnetic elements having designs which achieve improved heat transfer efficiencies.

SUMMARY

Aspects of embodiments of the present disclosure are directed toward a non-toroidal magnetic element. A plurality of coils is arranged in a linear configuration. Each coil may be a hollow cylinder, formed by winding a rectangular wire into a roll. The coils alternate with spacers. The coils may alternate in winding orientation. The inner ends of paired coils may be connected via a connection pin, or paired coils may be formed of a single continuous rectangular conductor. Small gaps are formed between the coils and spacers, e.g. as a result of each spacer having, on its two faces, a plurality of raised ribs, against which the coils abut. Cooling fluid is directed through the gaps to cool the coils.

According to an embodiment of the present disclosure there is provided a fluid-cooled magnetic element having a first electrically conductive coil, having a first annular surface and a second annular surface; a first spacer, the first spacer being electrically insulating and having a first flat face and a second flat face, the first flat face being separated from the first annular surface by a first gap; a fluid inlet; and a fluid outlet, wherein a fluid path extends from the fluid inlet to the fluid outlet through the first gap.

In one embodiment, the first electrically insulating spacer is a first sheet.

In one embodiment, the first coil is a hollow cylindrical coil and the fluid-cooled magnetic element includes a second hollow cylindrical coil, the second coil having a first annular surface forming a second gap with the second flat face of the first spacer.

In one embodiment, the first coil has an outer end and an inner end, and the second coil has an outer end and an inner end connected to the inner end of the first coil, and wherein a contribution to a magnetic field at the center of the first coil, from a current flowing through both coils in series, is in the same direction as a contribution to the magnetic field from the current flowing through the second coil.

In one embodiment, the fluid-cooled magnetic element includes: a plurality of pairs of coils including the first coil and the second coil; a plurality of active spacers including the first spacer; and a plurality of passive spacers, each of the active spacers having two flat faces and being between the two coils of a pair of coils of the plurality of pairs of coils, one coil of the pair of coils being on one of the flat faces, and the other coil of the pair of coils being on the other flat face, and each of the passive spacers being between a coil of one pair of coils and a coil of another pair of coils.

In one embodiment, the fluid-cooled magnetic element includes: a plurality of active spacers including the first spacer; a plurality of passive spacers; and a core portion, within the first coil and/or the first spacer, wherein a spacer of the plurality of active spacers and the plurality of passive spacers has two parallel, flat faces, and a fluid passage between the two faces, and wherein the fluid path further extends through a third gap, the third gap being a radial gap between the core portion and the first coil and/or the first spacer.

In one embodiment, the fluid-cooled magnetic element includes a core including the core portion, the core having a channel, wherein a fluid path extends from the fluid inlet to the fluid outlet through the channel.

According to an embodiment of the present disclosure there is provided a fluid-cooled magnetic element, including: a plurality of electrically conductive coils; and a plurality of electrically insulating spacers, each of the spacers being between a respective pair of adjacent coils of the plurality of coils, each of the plurality of coils including a face-wound electrical conductor and having a first inner end and a first outer end.

In one embodiment, the respective winding orientations of the coils alternate in at least a portion of the fluid-cooled magnetic element; and the first inner end of each of the plurality of coils is connected to the first inner end of a respective adjacent coil of the plurality of coils.

In one embodiment, each of the coils is a hollow cylinder having two parallel annular surfaces, and wherein each of the spacers is a sheet having two flat, parallel faces.

In one embodiment, each of the plurality of coils is a composite coil including n co-wound conductors and having n inner ends including the first inner end and n outer ends including the first outer end, and wherein a $j^{th}$ inner end of a coil of the plurality of coils is connected to an $(n-j+1)^{th}$ inner end of an adjacent coil of the plurality of coils.

In one embodiment, the plurality of electrically insulating spacers includes: a plurality of active spacers; and a plurality of passive spacers, wherein each active spacer includes n conductive pins extending through the active spacer, an inner end of a conductor of a coil on one flat face of the active spacer being connected and secured to one end of a pin of the n pins, and an inner end of a conductor of a coil on the other flat face of the active spacer being connected and secured to the other end of the pin.

In one embodiment, each annular surface of each of the coils is separated from an adjacent face of an adjacent spacer by a gap.

In one embodiment, the fluid-cooled magnetic element includes a housing containing the plurality of electrically conductive coils and the plurality of electrically insulating spacers, the housing having a fluid inlet and a fluid outlet, a fluid path from the fluid inlet to the fluid outlet including a portion within one of the gaps.

In one embodiment, each pair of coils that are connected together at their respective inner ends includes a single continuous conductor including the respective face-wound electrical conductors of the coils of the pair of coils.

In one embodiment, an outer end of a first coil of the plurality of coils is connected to an outer end of a second coil of the plurality of coils by a first bus bar.

In one embodiment, the fluid-cooled magnetic element includes: a first terminal; a second terminal; and a third terminal; and including: a first winding having a first end connected to the first terminal and a second end connected to the second terminal, and including a first coil of the plurality of coils and a second coil of the plurality of coils, the first coil and the second coil being connected in series; and a second winding having a first end connected to the third terminal and a second end, and including a third coil of the plurality of coils and a fourth coil of the plurality of coils, the third coil and the fourth coil being connected in series.

According to an embodiment of the present disclosure there is provided a fluid-cooled magnetic element, including: a plurality of electrically conductive coils; a plurality of electrically insulating spacers; a fluid inlet; and a fluid outlet, each of the spacers being between two adjacent coils of the plurality of coils, each of the coils including a face-wound electrical conductor, each of the coils having two annular surfaces, each annular surface of each of the coils being separated from an adjacent face of an adjacent spacer by a gap, wherein a respective fluid path extends from the fluid inlet to the fluid outlet through each of the gaps.

In one embodiment, each of the gaps has a width greater than 0.001 inches and less than 0.070 inches.

In some embodiments, the fluid-cooled magnetic element is configured to cause, in a condition of steady-state fluid flow, at least 50% of fluid received at the fluid inlet to flow to the fluid outlet through the gaps.

In one embodiment, the fluid-cooled magnetic element includes a clamp configured to apply a compressive force to the plurality of electrically conductive coils and the plurality of electrically insulating spacers.

In one embodiment, the fluid-cooled magnetic element includes a core, a portion of the core being within a coil of the plurality of coils or a spacer of the plurality of spacers, the core include a first core segment and a second core segment.

In one embodiment, the fluid-cooled magnetic element includes a flux director, the flux director being a ferromagnetic element around the core and adjacent to an end coil of the plurality of coils.

In one embodiment, the plurality of electrically conductive coils and the plurality of electrically insulating spacers are arranged in a stack, and the fluid-cooled magnetic element includes a structure at an end of the stack to limit flow of fluid into or out of the end of the stack.

In one embodiment, the fluid-cooled magnetic element includes a terminal board including:

a first conductive layer; and an insulating overmold, the insulating overmold extending between, and around a portion of, the first conductive layer, the first conductive layer including a first conductive plate having a plurality of winding end terminals extending past a perimeter of the overmold.

BRIEF DESCRIPTION OF THE DRAWINGS

These and other features and advantages of the present invention will be appreciated and understood with reference to the specification, claims, and appended drawings wherein:

Each drawing is drawn to scale, for a respective embodiment, except where otherwise indicated.

DETAILED DESCRIPTION

The detailed description set forth below in connection with the appended drawings is intended as a description of exemplary embodiments of a fluid cooled magnetic element provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1A:
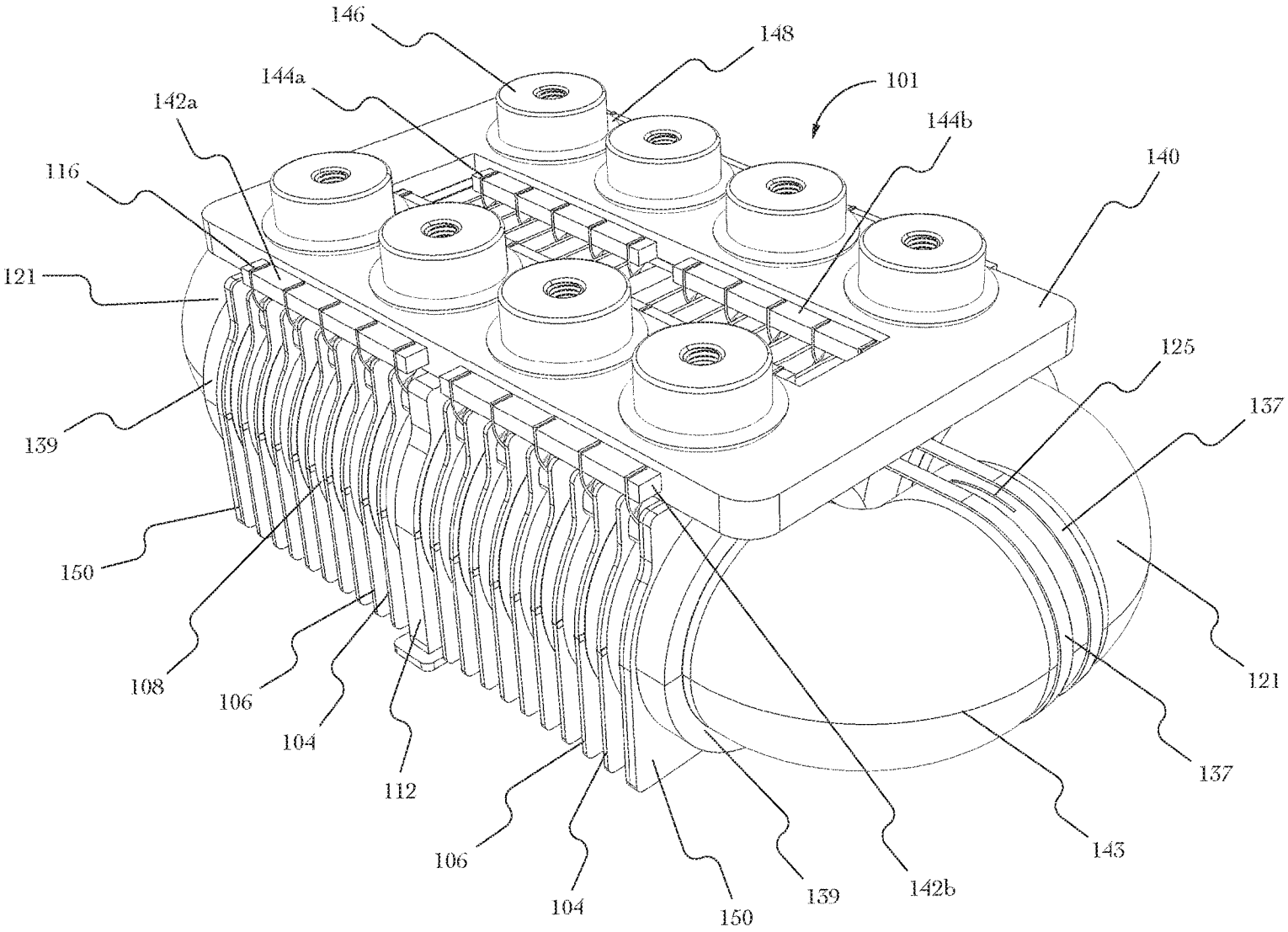
FIG. 1*a* is a perspective view of a magnetic assembly using a U-U ferro-core, according to an embodiment of the present invention.
Figure 1B:
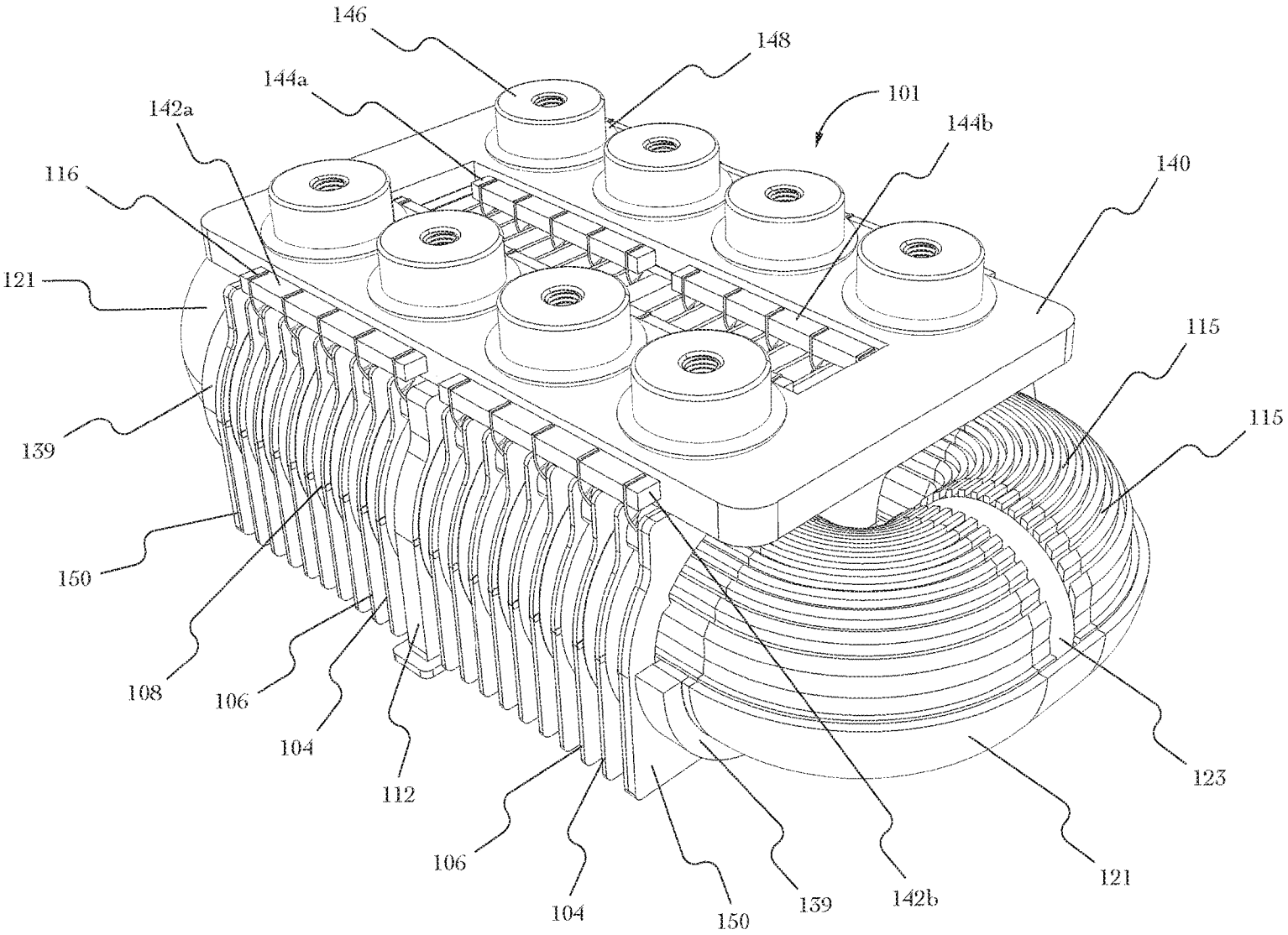
FIG. 1*b* is a partially disassembled perspective view of a magnetic assembly using a U-U ferro-core, according to an embodiment of the present invention.
Figure 1C:
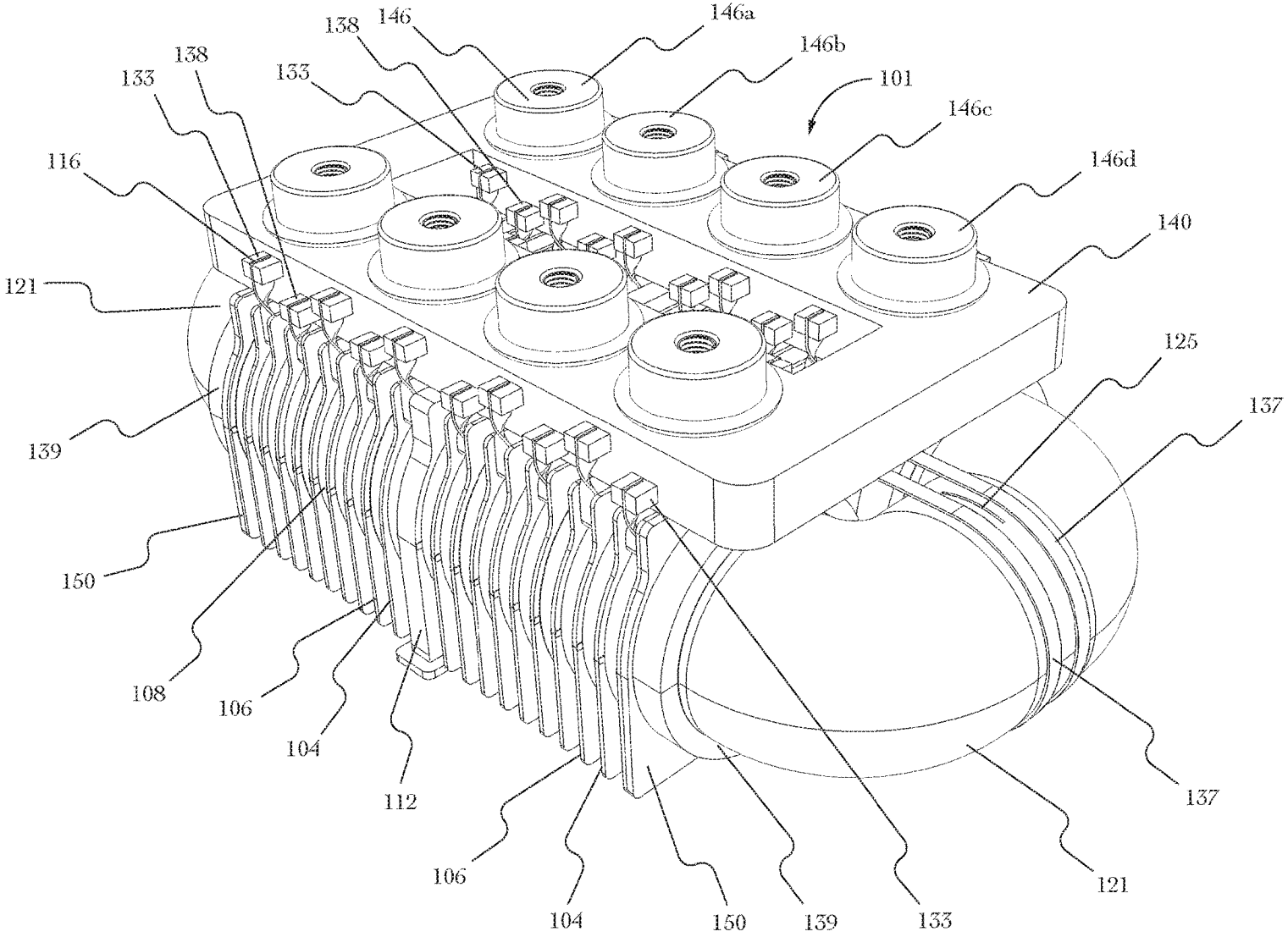
FIG. 1*c* is a perspective view of a magnetic assembly using a U-U ferro-core, according to an embodiment of the present invention.
Figure 1D:
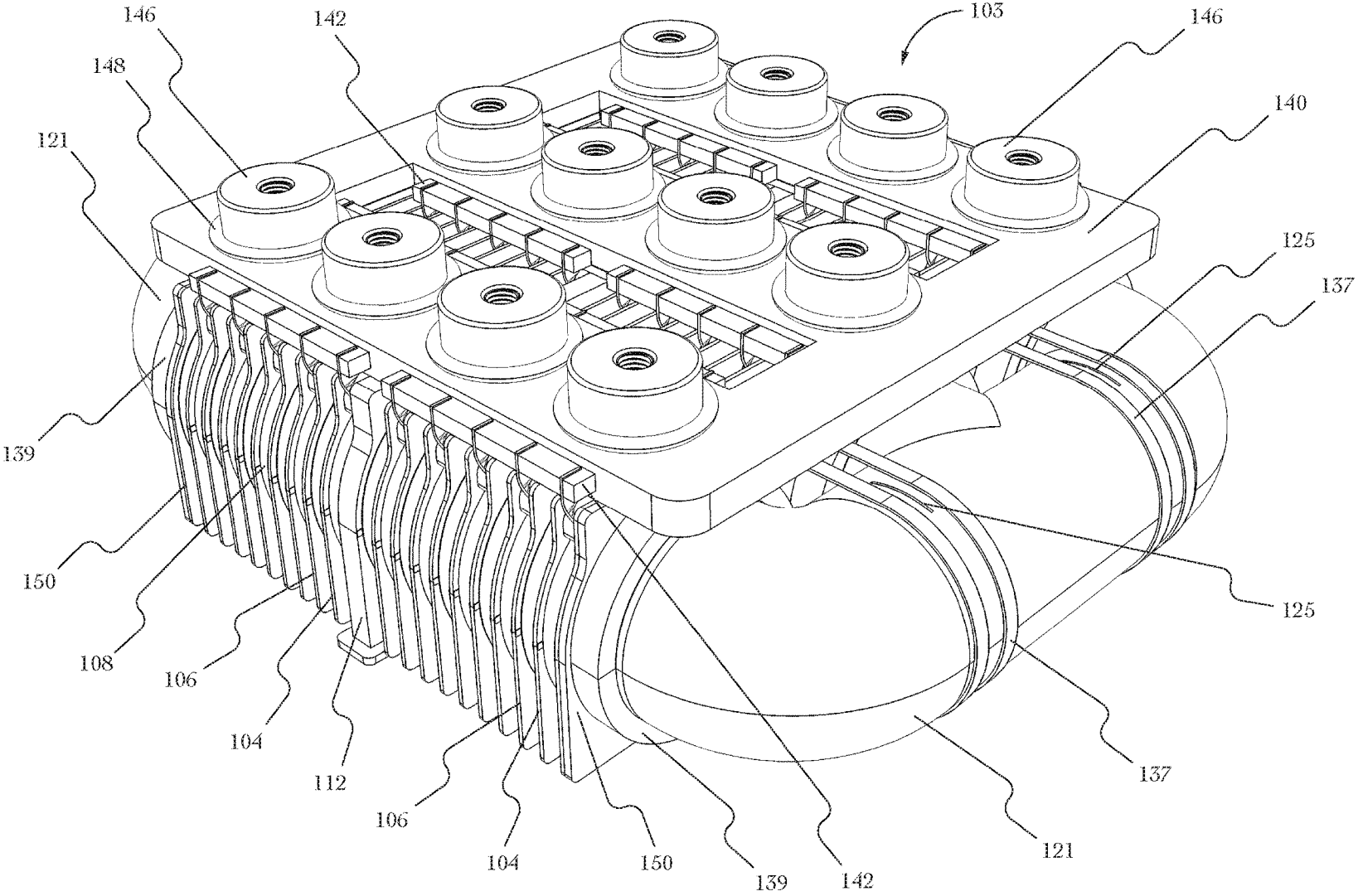
FIG. 1*d* is a perspective view of a magnetic assembly using an E-E ferro-core, according to an embodiment of the present invention.

Two embodiments of a fluid cooled magnetic element are shown. In FIGS. 1*a*-1*c*, embodiments are shown which use two "U" shaped ferro-core halves and in FIGS. 1*d* and 2, embodiments are shown which use two "E" shaped ferro-core halves. The embodiments of FIGS. 1*a*-1*d* and FIG. 2 include a winding assembly 101, a terminal board 140, and a ferro-core 130 (including core portions 130*a* and 130*b*) (or core 131 (which includes core portions 131*a* and 131*b*) in the case of the embodiment of FIG. 2). As shown, for example, in FIG. 11, these elements may be contained within an enclosure which includes an enclosure top 162, and an enclosure bottom 172. Cores (or, e.g., core halves) may be fabricated from a powder such as ferrite or powdered iron, or they may also be fabricated from stacked laminations which are bonded together. If the magnetic element is to be used as an inductor, one or more core gaps may be included.

Figure 3:
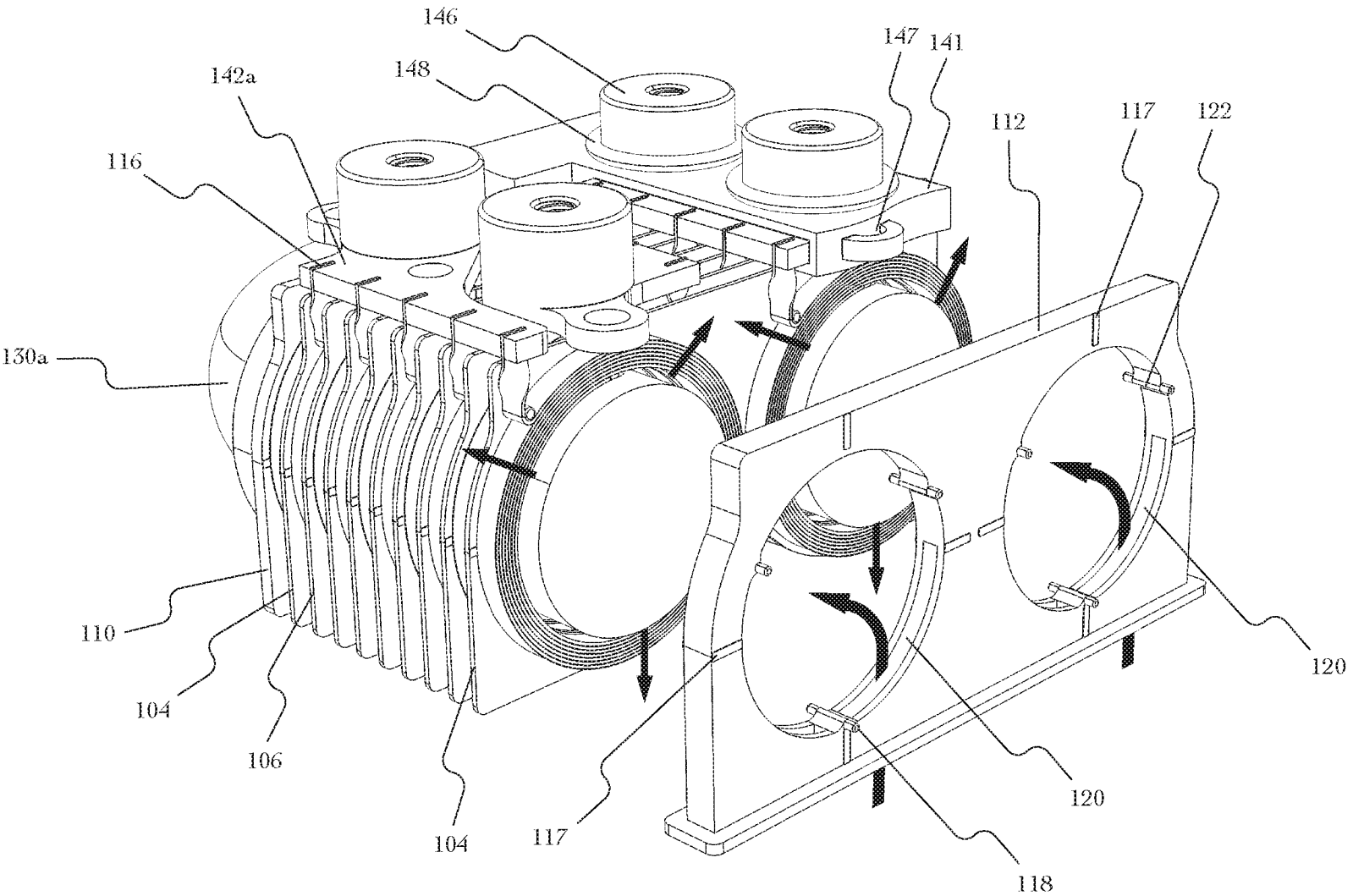
FIG. 3 is an exploded perspective partial view of a magnetic assembly using a U-U ferro-core, according to an embodiment of the present invention.
Figure 4:
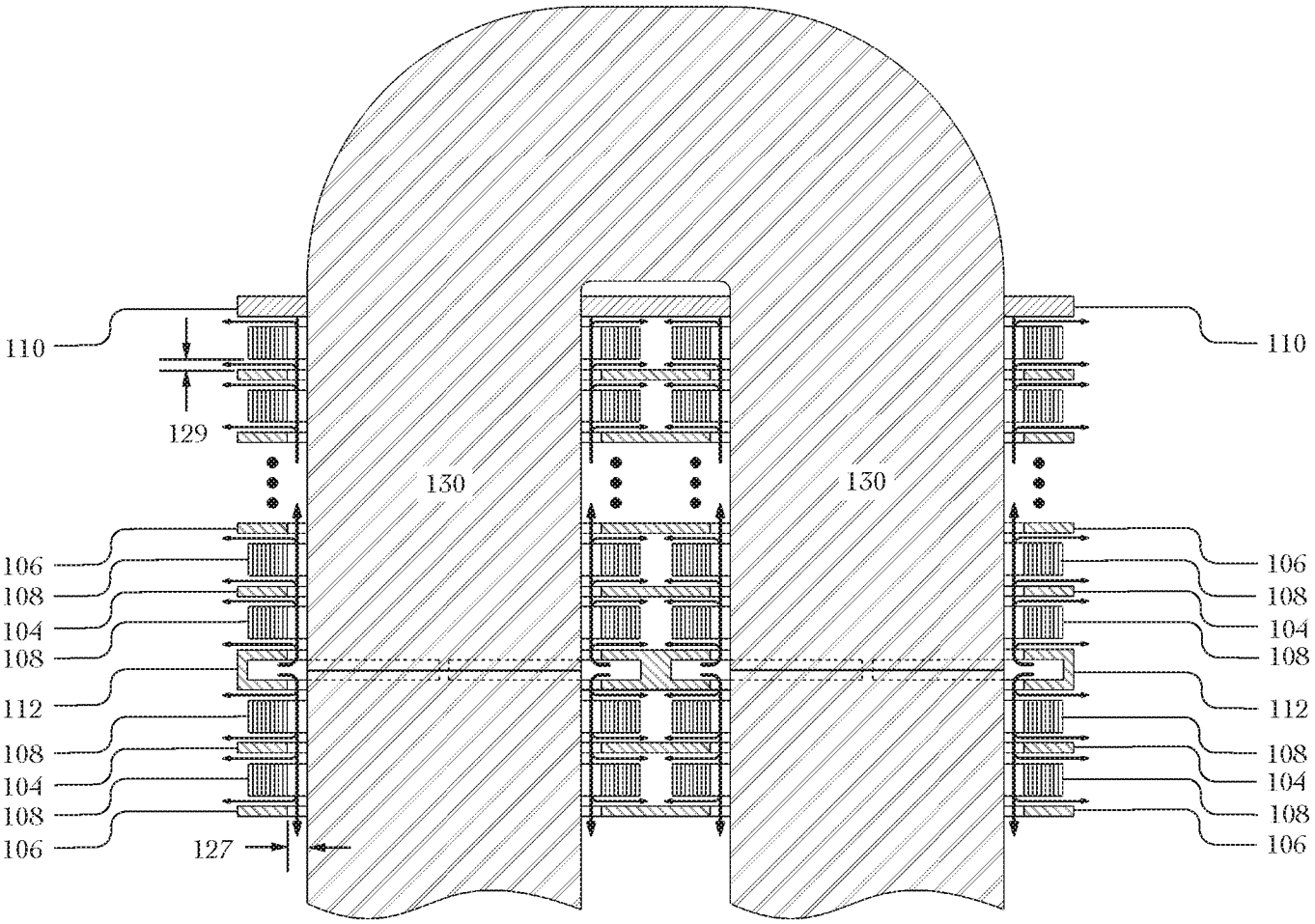
FIG. 4 is a sectional view of a magnetic assembly using a U-U core, according to an embodiment of the present invention.

In turn, winding assembly 101 is a stack which consists of multiple coils 108 separated by active spacers 104 (105 in the case of the embodiment of FIG. 2) and passive spacers 106 (107 in the case of the embodiment of FIG. 2) and held under compression by flow-restricting end plates 110. Coils 108, active spacers 104 (or 105), and passive spacers 106 (or 107) are centrally open such that the ferro-core 130 (131 in the case of the embodiment of FIG. 2) can be centrally contained to complete the magnetic structure. An annular gap 127 is established between core 130 and the combination of coils 108 and active spacers 104 and passive spacers 106 as shown in FIGS. 3 and 4. Coolant flow is introduced into this annular gap 127 via feed plate 112. Coolant flow then proceeds axially and radially exits through flow gaps 129 which are present between coil faces and the faces of active spacers 104 and passive spacers 106.

Axial flow may be reduced (as a result of radial flow through the flow gaps 129) at the ends of the winding assembly 101; the remaining axial flow may continue into cooling channels 115 in the core 130 and within one of two shrouds 121 surrounding the portions of the core that are not within the winding assembly 101. Fluid from the cooling channels 115 may be collected in a collection channel 123 and, from there, flow out of the shroud 121 through a bleed slot 125, which may be sufficiently narrow that a sufficient pressure differential remains, between the interiors and exteriors of the coils 108, to drive fluid through the flow gaps 129. In some embodiments, flow paths that bypass the flow gaps 129 (such as the paths through the cooling channels 115 and the bleed slot 125) are sufficiently restricted that a substantial fraction (e.g., in the range 10%-100%, e.g., at least 50%) of the fluid that flows from the inlet through the outlet flows through one of the flow gaps 129. In some embodiments the shrouds 121 are omitted and the axial flow is instead restricted at the ends of the winding assembly 101 by flow-restricting end plates 110 (FIG. 4).

In FIGS. 1*a* and 1*b*, winding ends are connected to terminal bus bars 142*a*, 142*b*, 144*a*, 144*b* (collectively referred to as 142 and 144), there being five winding ends connected to each of the terminal bus bars 142*a*, 142*b*, 144*a*, 144*b*, so that the windings (each of which consists of two series-connected coils, as discussed in further detail below) are connected in parallel in groups of five. Each group of five parallel-connected windings terminates at two terminal posts 146. External connections may then be made to the terminal posts 146, to connect the groups in parallel, in series, or as a transformer, for example. FIG. 1*c* shows an embodiment differing from that of FIG. 1*b* in that a terminal board 140 providing alternating winding end terminals 133 is used (as discussed in further detail below). One or more compression bands 137 may act as clamps to provide a compressive force to the stack of coils 108 and spacers 104, 106 (e.g., through compliant end plates 150, which may deform to compensate for thickness variations). Compliant end plates 150 may or may not be flow-restricting; in various embodiments, the end plates may be any combination of flow-restricting or not flow-restricting, and compliant or rigid. In other embodiments, wedges 190 (FIG. 11) may instead be used as clamps, to similar effect. One or more flux directors 139 may serve to provide a path for leakage flux, such that eddy losses generated by leakage flux within the winding are minimized. Each flux director 139 may be composed of bonded ferromagnetic powder overmolded onto the shroud 121 (or, in embodiments lacking a shroud (e.g., FIG. 11), each flux director 139 may be integral with, or overmolded onto, a respective core portion 130*b*). Each shroud may be composed of two halves meeting at a shroud seam 143 as shown. Each flux director 139 may similarly be formed of two halves.

FIG. td shows a three-phase liquid-cooled magnetic element which comprises three-phase core consisting, for example, of use two "E" shaped ferro-cores and a winding assembly 103 including three sets of windings, each on a respective one of the three prongs of the double-E ferro-core. In turn, each winding consists of pairs of coils 108 which connect to terminal bus bars 142. Coolant flow and mechanical details may be generally similar to that of the embodiment of FIG. 1*a* (which may be used for single-phase applications), or of FIG. 4. In some embodiments, the three core prongs are identical and the three winding sets are identical. In some embodiments, one of the winding sets may differ from another one of the winding sets; likewise, in some embodiments, it one of the core prongs may differ from the other two.

A single terminal board may be used to form connections from external cables to the windings, or several (e.g., three) terminal boards may be used (e.g., one terminal board being used for each winding set). Feed plate 112 may be fabricated as a single, common element, or, e.g., as three separate elements. In some cases, the feed plate may be an integral part of the housing. Likewise, compliant end plate 150 may be a single, common element, or, e.g., three separate elements.

Flow detail is depicted schematically in FIG. 4. FIG. 4 is not drawn to scale. Coolant flow serves to remove heat generated both in ferro-core 130 (or 131) and coils 108.

Figure 7A:
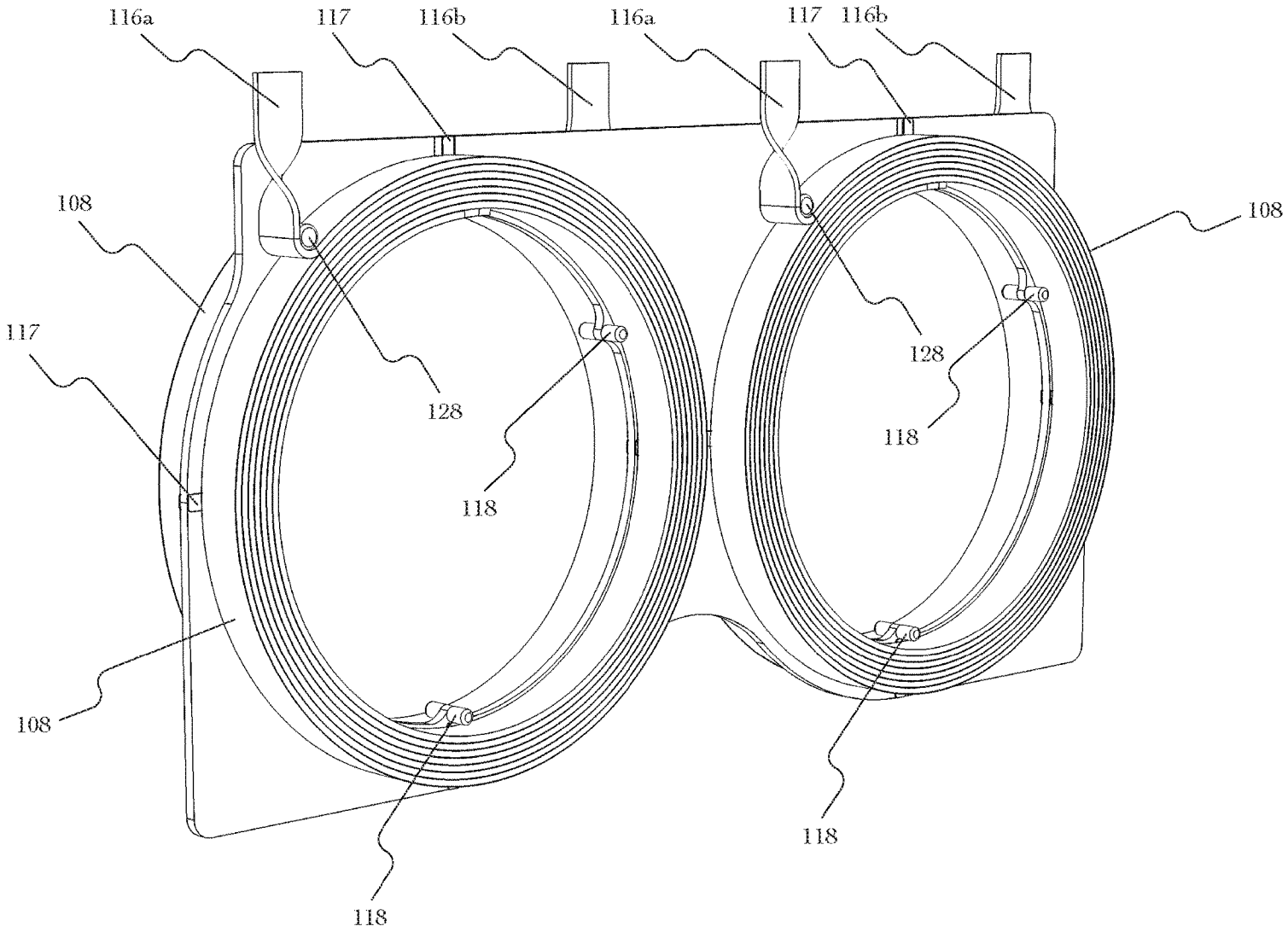
FIG. 7*a* is a perspective view of an active spacer including attached coils of a magnetic assembly, according to an embodiment of the present invention.
Figure 7B:
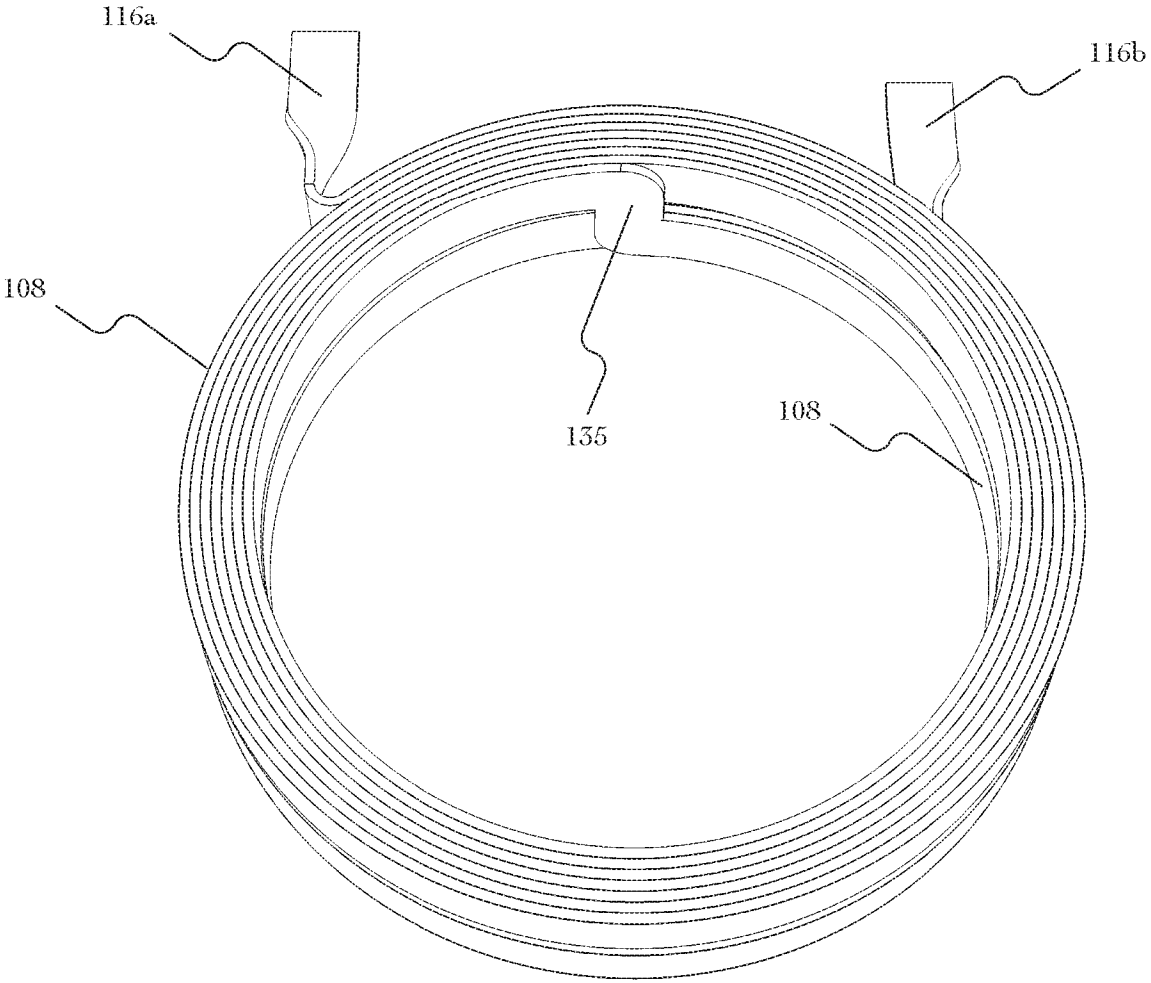
FIG. 7*b* is a perspective view of a pair of coils of a magnetic assembly, according to an embodiment of the present invention.
Figure 10A:
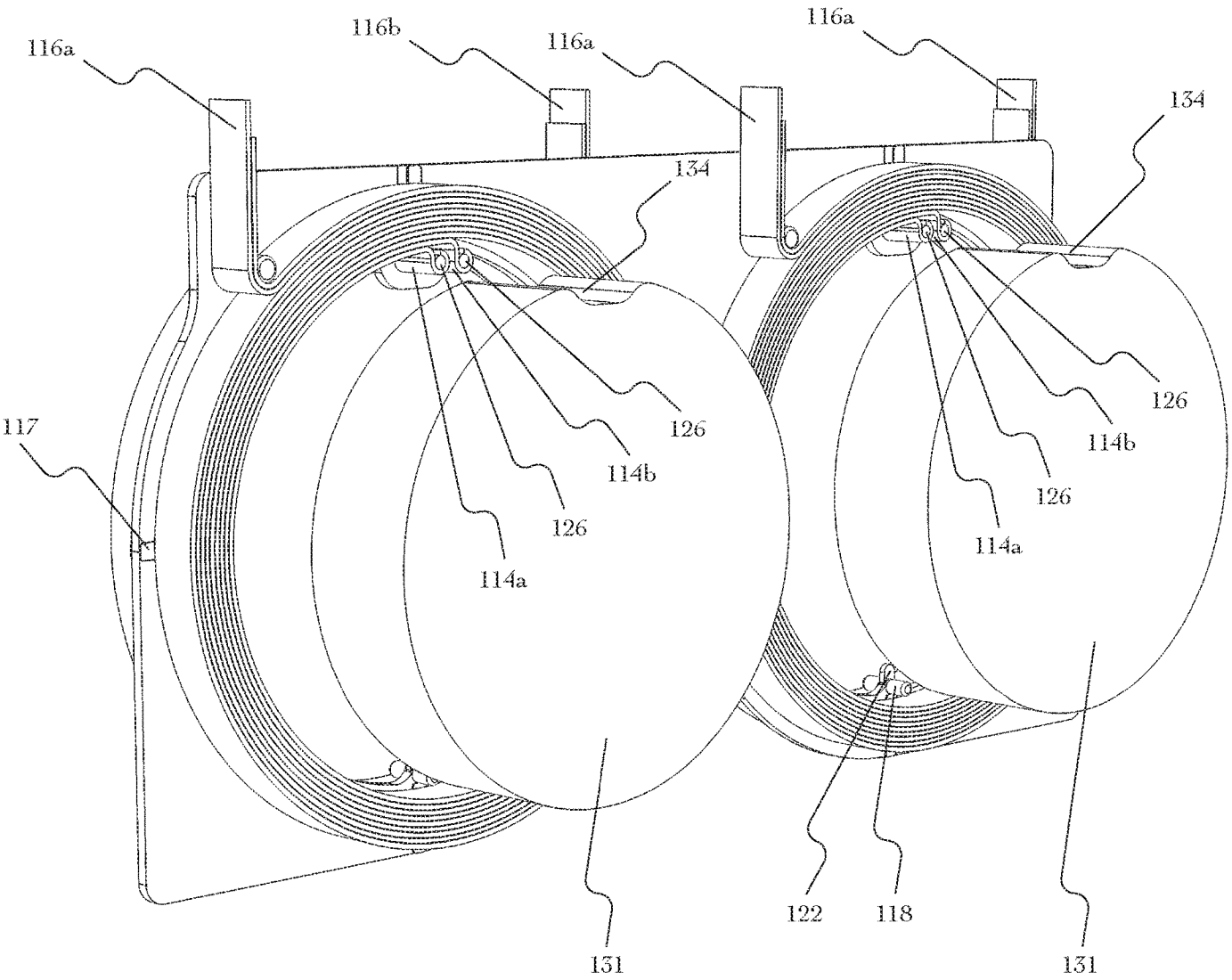
FIG. 10*a* is a perspective view of an active spacer including attached two-layer coils of a magnetic assembly, according to an embodiment of the present invention.
Figure 10B:
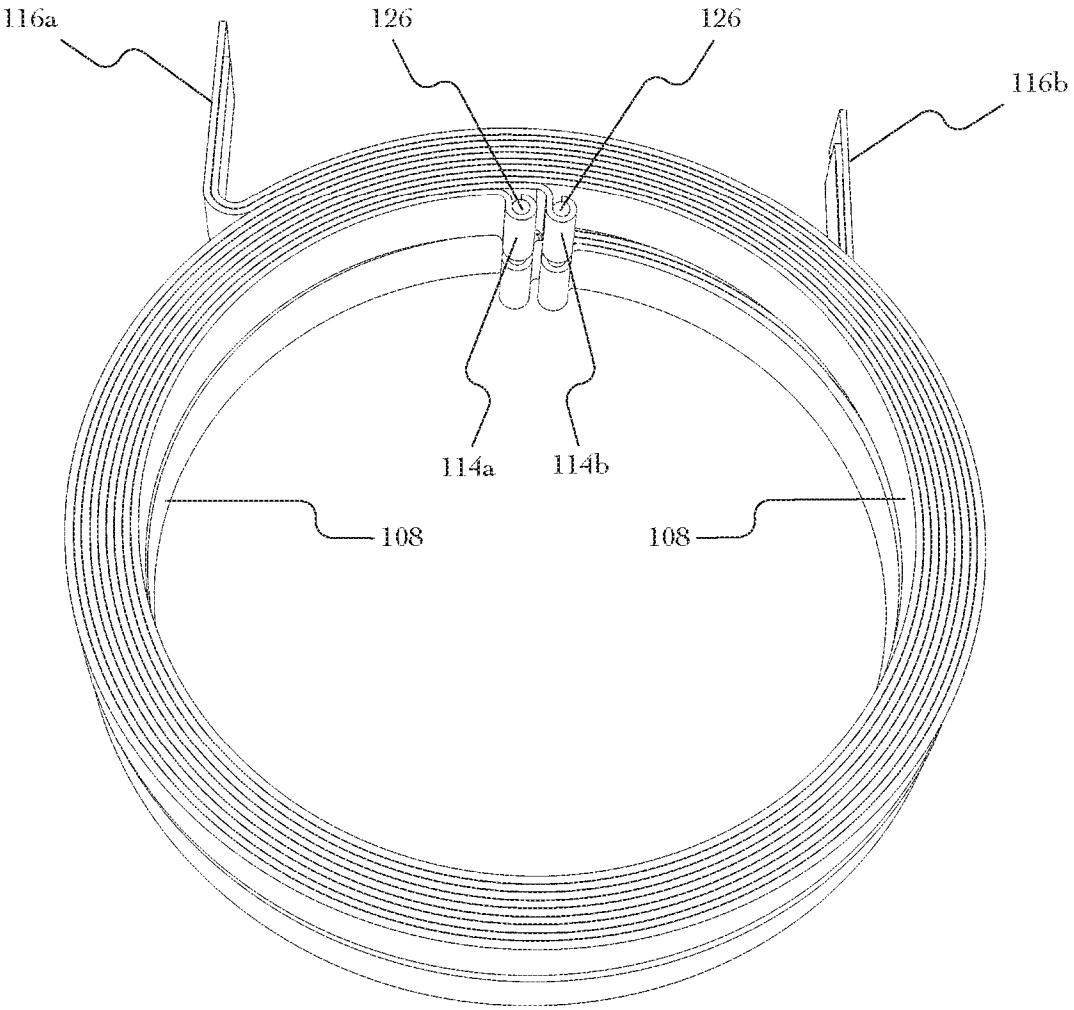
FIG. 10*b* is a perspective view of a pair of coils of a magnetic assembly, according to an embodiment of the present invention.

As shown in FIG. 7*a*, coils 108 are attached to active spacers 104 (or 105) and connected in pairs to form windings each having a first winding lead 116*a* and a second winding lead 116*b* (collectively referred to as winding leads 116). The inner end 114 of one coil of each pair may be connected to the inner end 114 of an adjacent coil (the other coil of the pair) by an S-bend 135 in the conductor (so that the pair of coils is formed as a single continuous conductor, see FIG. 7*b*), or the inner ends 114 may be interconnected via pins 126 (as shown in FIG. 10*b*) to form winding elements (each winding element consisting of one such pair of coils, connected together at their inner ends). With this interconnect method, the problem of "buried" coil starts is eliminated. When the coils of a pair are connected by an S-bend 135 in the conductor, the two coils 108 can be wound as a single unit (where no splice is involved). When this is done, a slot 152 (FIG. 5) may be included in the periphery of active spacer 104 (or 105) to allow insertion of the joining conductor during assembly of the winding with the active spacer. The slot may be sufficiently narrow to avoid an unacceptably high rate of fluid flow through the slot during operation; in some embodiments, if the slot is narrower than the coil wire, the spacer may be flexed so as to open the slot temporarily during assembly to allow the wire (of the S-bend) to pass through the slot 152. In other embodiments the coils may be wound in place on the active spacer, and the slot 152 may be absent.

It should be noted that the arrangement of FIG. 7*a*, where four coils 108 are shown, applies, for example, to embodiments such as those of FIGS. 1*a*-1*c* where two "U" cores are used. In the case of the embodiment of FIG. 2, only two interconnected coils 108 are contained on one active spacer 104. Coils 108 may be fabricated from rectangular copper or aluminum wire which is coated with a thin insulation such as polyester. An outer bond coat such as a thermally activated epoxy may be added such that the coils can be self-bonded prior to assembly. In all cases, passive spacers 106 may be placed between adjacent winding elements.

The two coils of each pair of coils are installed in different winding orientations on two respective faces of the spacer 104 (or 105), so that, for example, (viewed from one direction) current may flow clockwise from the outer end to the inner end of a first coil of the pair of coils, then to the inner end of a second coil of the pair of coils, and then (viewed from the same direction) clockwise again, from the inner ends to the outer ends of the second coil. In this arrangement the magnetic field contributions produced by the two coils of the pair of coils are in the same direction (i.e., not in opposite directions) along the central axis of the two coils. Other coils in an stack of coils may be similarly wound, so that the respective winding orientations of the coils alternate along the stack.

Figure 5:
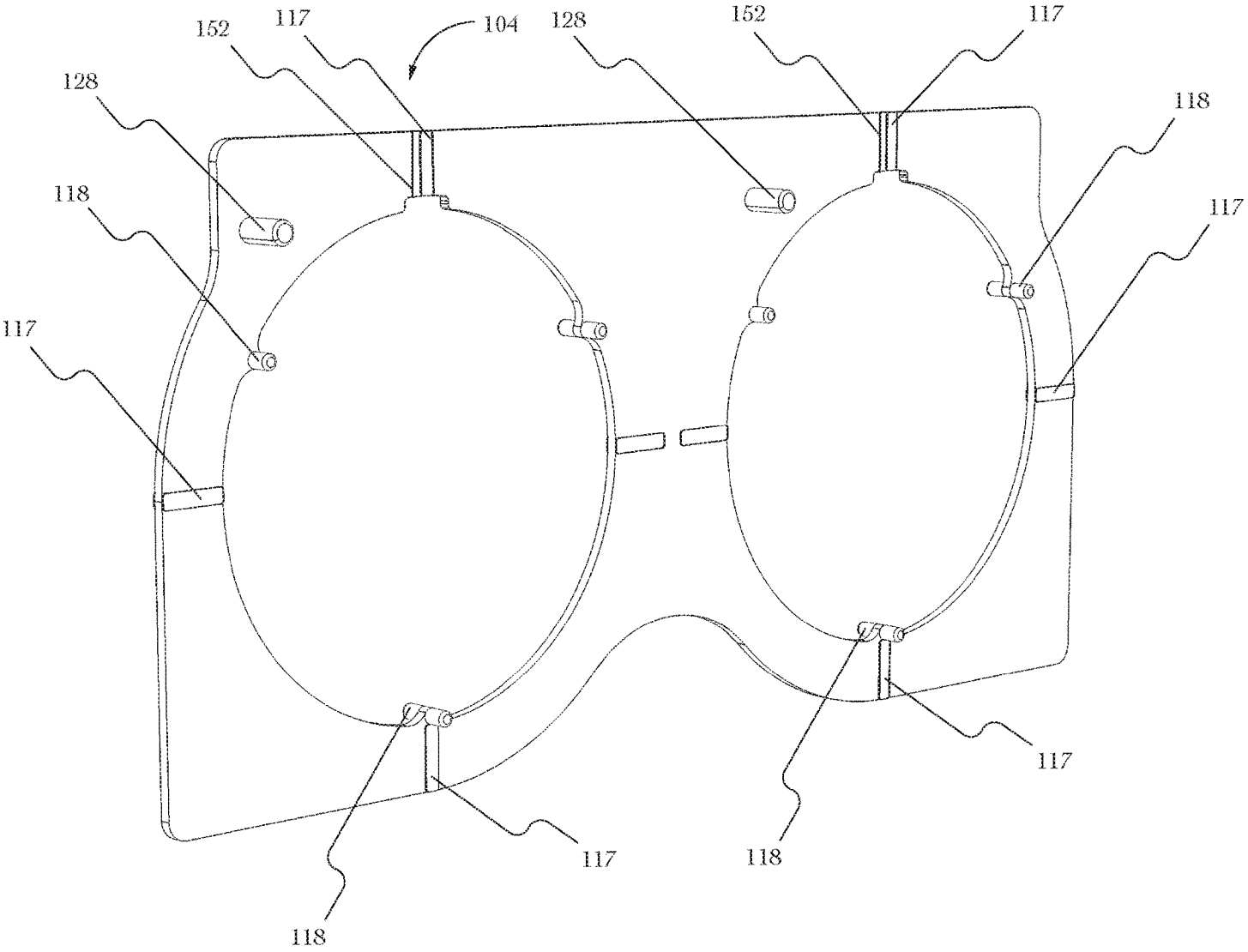
FIG. 5 is a perspective view of an active spacer of a magnetic assembly, according to an embodiment of the present invention.
Figure 6:
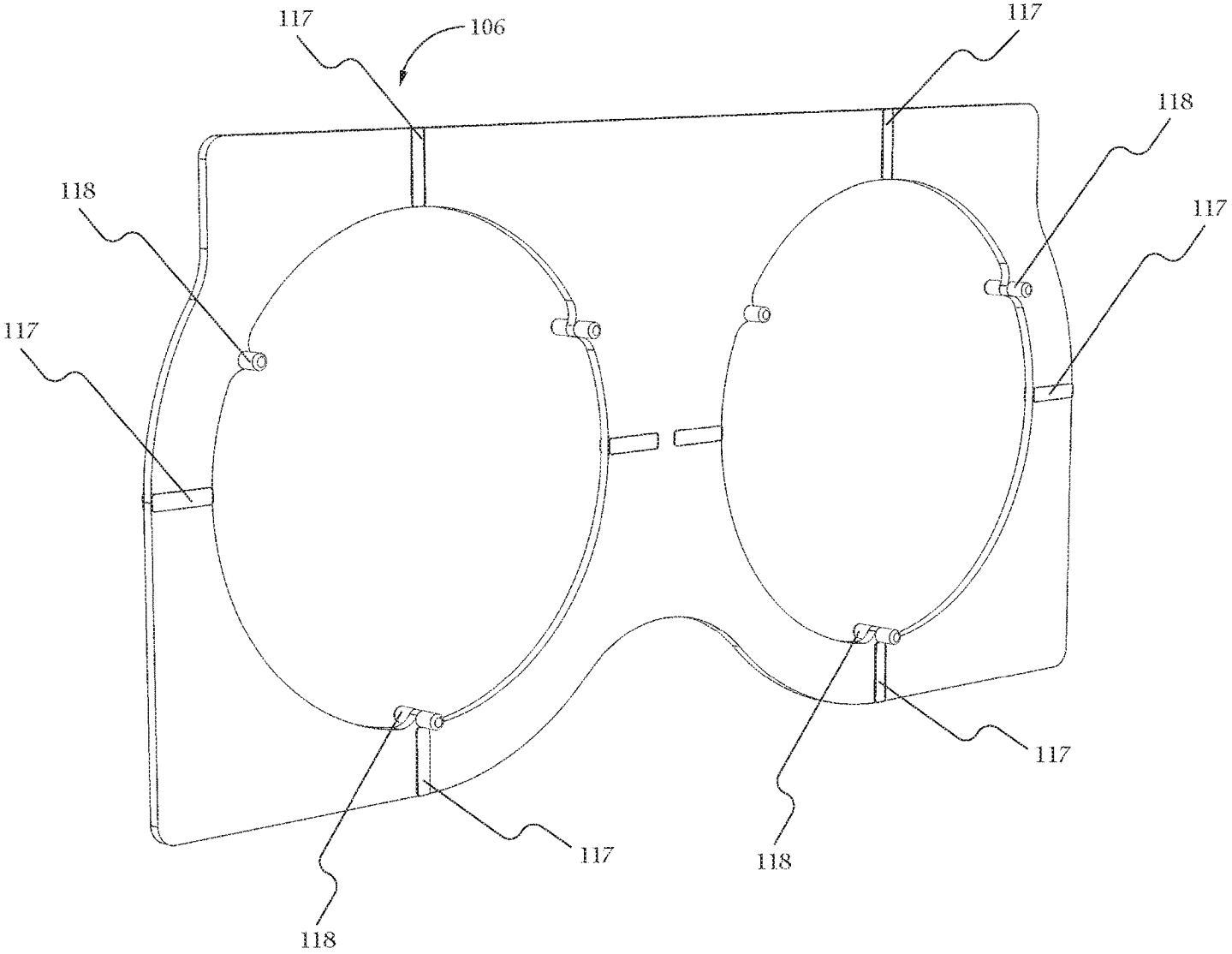
FIG. 6 is a perspective view of an passive spacer of a magnetic assembly, according to an embodiment of the present invention.

As shown in FIGS. 5 and 6, both active spacers 104 and passive spacers 106 include raised surface ribs 117 which establish coolant flow gaps 129 between coil faces and spacer faces. Alternatively, raised surface ribs may instead be added to the coil faces. Both spacer types include coil support tigs 118 which serve to secure and align coils 108; active spacers also may include strain relief posts 128 (see FIGS. 5 and 7*a*) which anchor winding leads such that strain relief is provided. This feature may assist during assembly and serves to prevent coils 108 from becoming detached.

By maintaining small values (i.e., widths) of flow gaps 129, efficient heat transfer from coils 108 to coolant can be achieved—which enables coils 108 to handle high current densities—e.g., greater than 50 A/mm$^2$. This in turn enables very high specific power levels to be handled—for example, greater than 300 kW/kg for transformers operating at 20 kHz. As flow gaps 129 are reduced, heat transfer from coils 108 to coolant is improved at the expense of increased head loss. As such, there exists an optimal gap size which minimizes the overall thermal impedance—for a given head loss and coolant viscosity. In some embodiments the annular gap 127 has a gap width of 0.050". In some embodiments the flow gap 129 has a gap width of 0.004", or between 0.001" and 0.070", as discussed in further detail below. Spacers may be fabricated as injection molded thermo-plastics or injection molded thermo-sets.

The width of the flow gap may affect the performance of the magnetic element. As the flow gap 129 (g) (i.e., the width of the flow gap) is reduced, the characteristic heat flow length within the coolant is reduced—which serves to reduce the thermal conductivity component of thermal impedance. Conversely, as g is increased, the coolant flow rate increases—which serves to decrease the thermal mass component of thermal impedance. Because of these opposing effects, it follows that there exist an optimum value for the flow gap (under conditions of constant head loss) which results in a minimum for the overall thermal impedance. Based on first principles, this optimal gap ($g_{opt}$) is found as $$g_{opt}=3.46[(\mu K\Delta R^2)/(c_p\rho P)]^{0.25},$$

where μ is the coolant dynamic viscosity, K is the coolant thermal conductivity, $c_p$ is the coolant specific heat, ρ is the coolant mass density, P is the coolant head loss caused by the gap, and ΔR is the radial build of the coil. The corresponding heat transfer ($h_c$) coefficient (e.g. W/m$^2$/C) is found as $$h_c=0.865[(c_p\rho PK^3)/(\mu\Delta R^2)]^{0.25}$$

In one embodiment, where transformer oil is the coolant, the radial build is 1 cm (0.010 m), and the head loss is 1 psi (6895 Pa), the above equations may be used to find the optimal gap and the corresponding heat transfer coefficient. (For transformer oil at 60 C, μ=0.01 Pa-sec, K=0.2 W/m/C, $c_p$=1800 J/kg/C, and ρ=880 kg/m$^3$.) The optimal gap is found as 0.065 mm or 0.00261 inch. The corresponding heat transfer coefficient is found as 2644 W/m$^2$/C.

From the first equation, it is noted that the optimal gap grows as the square root of the radial build. Increasing ΔR by a factor of ten causes the gap to grow by about a factor of three. Noting further that all of the other factors are taken to the one fourth power, it follows that the gap changes slowly with respect to any of these.

In the case where high values of P, and small values of ΔR are used, optimal gap values could be on the order of 0.001 inch. However, fabrication, tolerance and stability considerations will typically call for increased gap values. Accordingly, in some embodiments the gap width set at about 0.001 inch. Likewise, for large coils, where the radial build is on the order of 0.1 m, a relatively viscous coolant is used (e.g. μ=0.1 Pa-sec), and head loss is small (e.g., 0.25 psi or 1750 Pa), the optimal gap calculates as 1.8 mm=0.071 inch. (The corresponding heat transfer coefficient is 332 W/m$^2$/C.) Accordingly, in some embodiments the gap may be as large as 0.07 inches.

In some embodiments, a gap differing from the optimal gap by as much as a factor of three (i.e., a gap in the range of 0.33 $g_{opt}$-3.00 $g_{opt}$) may be used, without an unacceptable degradation of performance. In some embodiments, Class H materials, which may be rated for 180 degrees C., may be used, and the temperature difference between the inlet and the outlet may be as much 100 degrees C. In some embodiments a design such as that of FIG. 1 may have an overall length of about 10 inches and be capable of withstanding about 5 kW (e.g., at least 1 kW) of dissipated power (which may correspond to about 1 MW of through power). A pressure difference of 1 psi (e.g., in the range from 0.2 psi to 5.0 psi) may be provide sufficient fluid flow in such an embodiment.

In addition to providing mechanical support for the windings, spacers 104 and 106 provide electrical insulation between adjacent coils 108. By increasing spacer dimensions, the breakdown voltage between adjacent coils 108 can be increased. Furthermore, as the thickness of spacers 104 and 106 is increased, the capacitance between adjacent coils 108 can be reduced.

Figure 2:
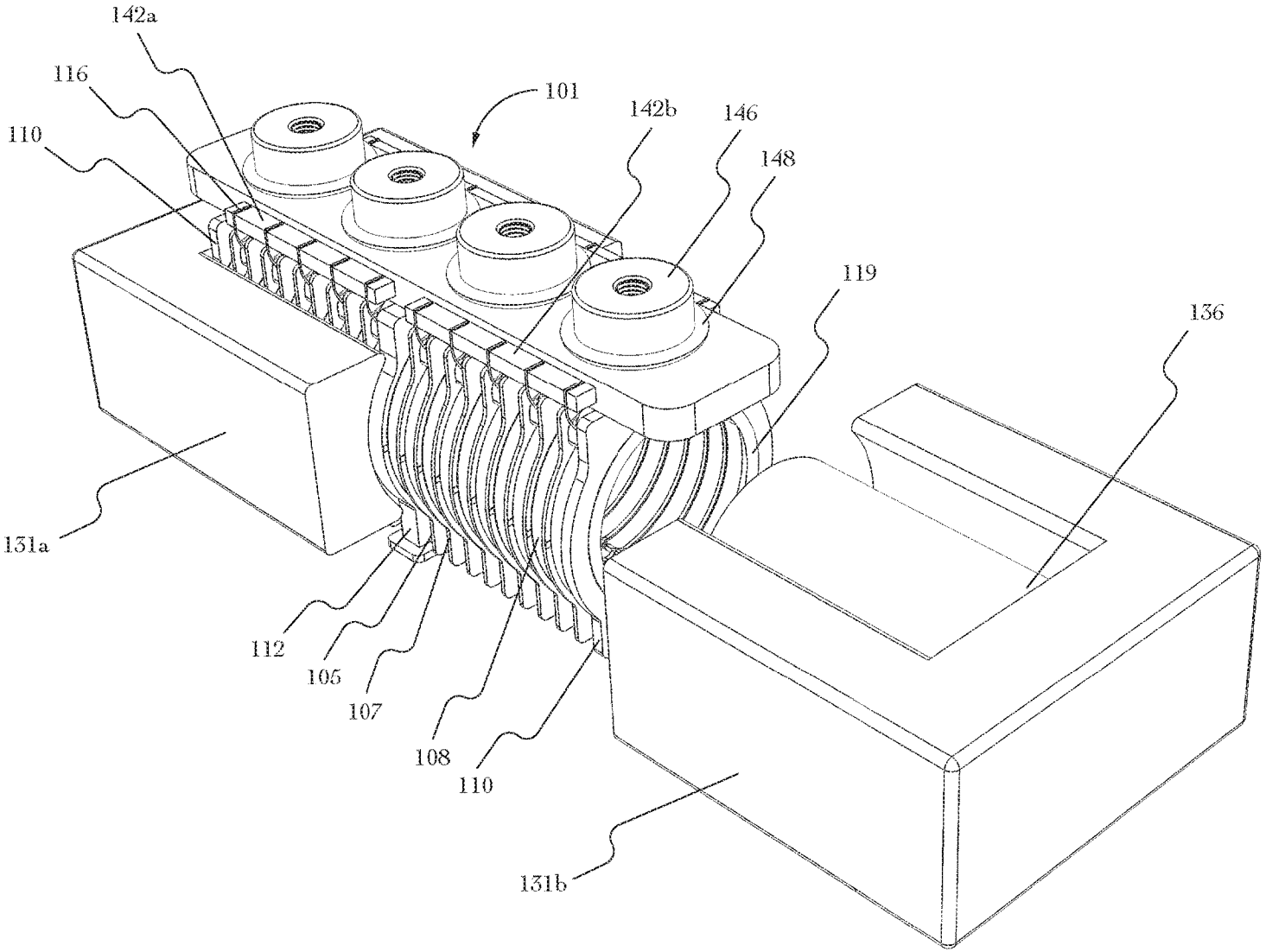
FIG. 2 is an exploded perspective view of a magnetic assembly using an E-E ferro-core, according to an embodiment of the present invention.
Figure 9:
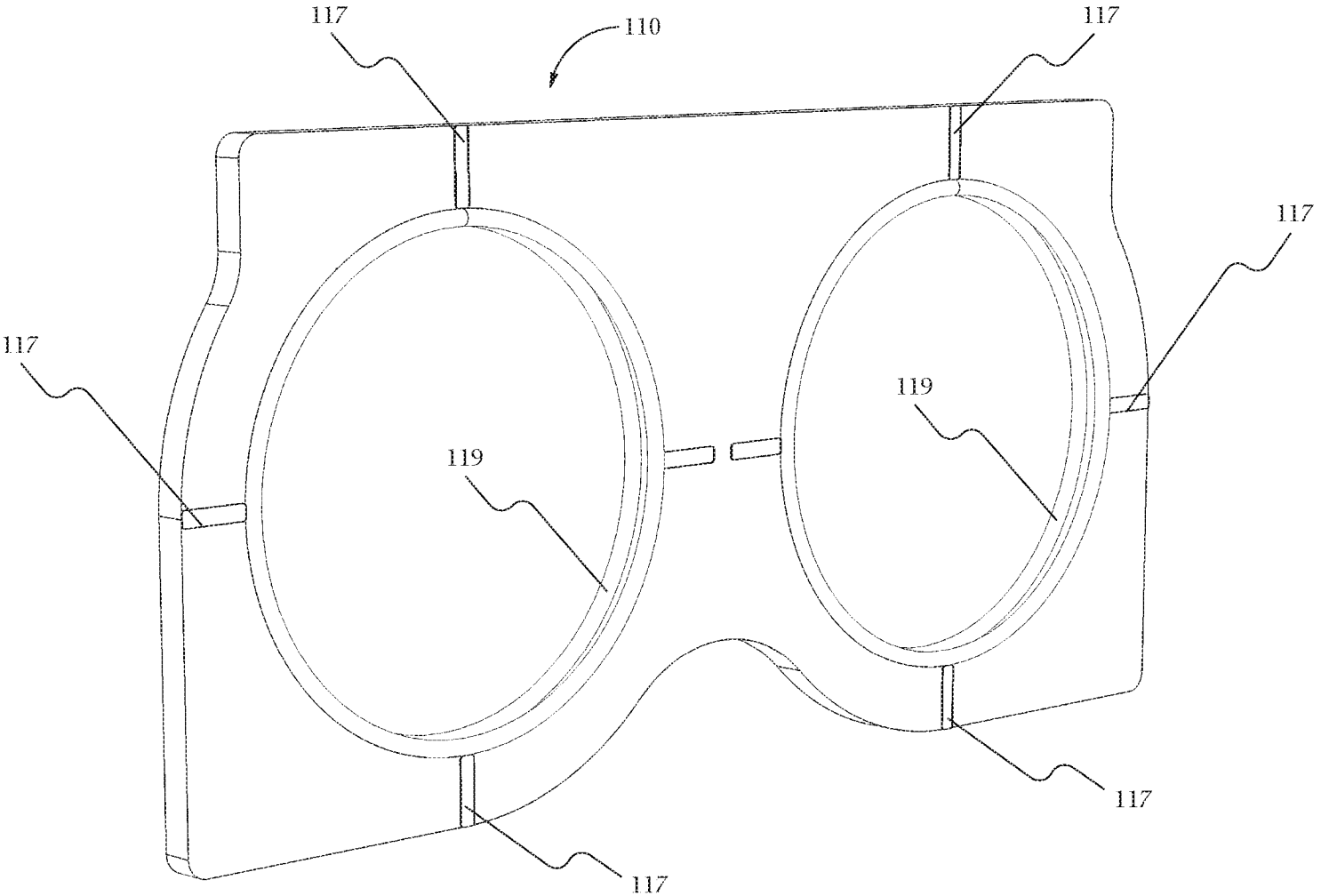
FIG. 9 is a perspective view of an end plate of a magnetic assembly, according to an embodiment of the present invention.
Figure 11:
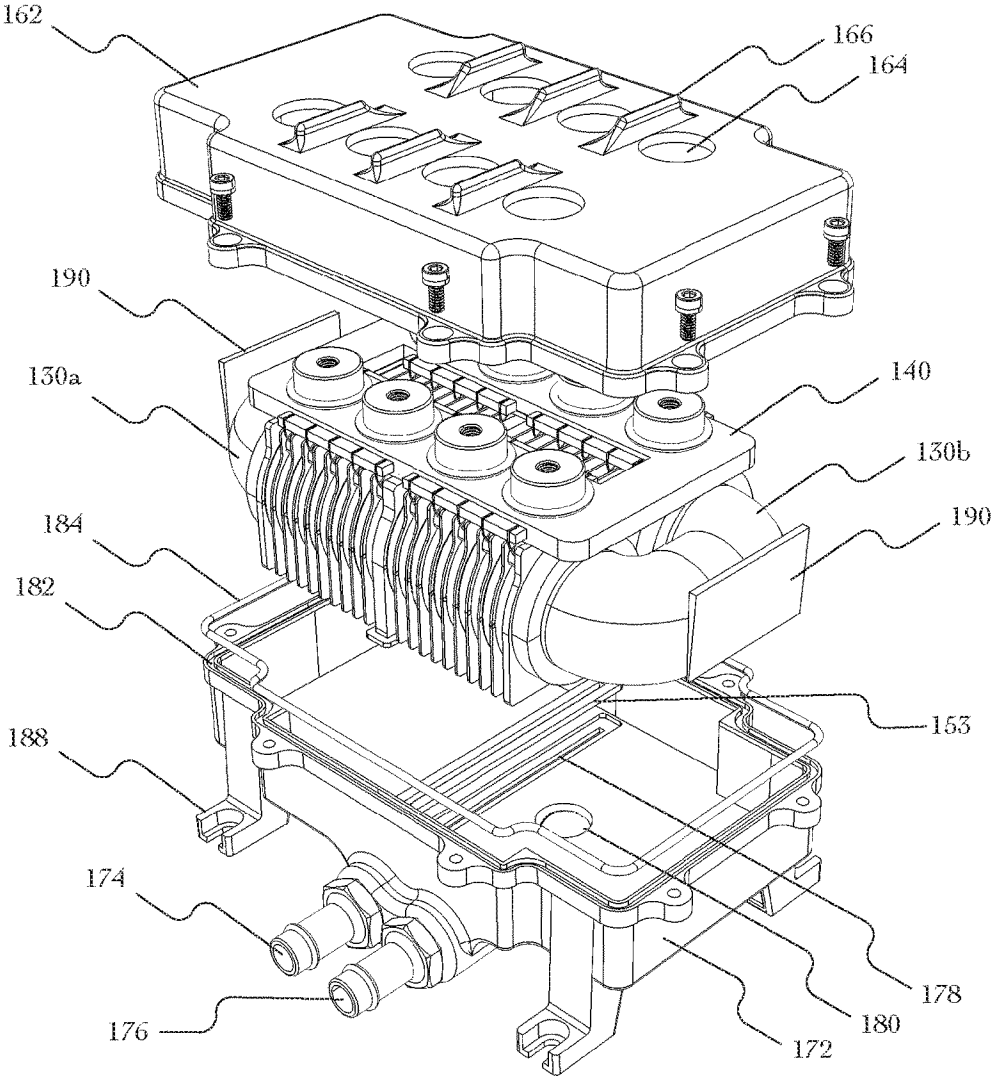
FIG. 11 is an exploded perspective view of the complete magnetic assembly including an enclosure, according to an embodiment of the present invention.

Flow-restricting end plates 110, when present, may hold the winding stack under compression, and serve to restrict axial coolant flow, (e.g., when no shroud 121 is used, as shown in FIGS. 2, 4 and 11). This function is achieved by end plate sealing flange 119 which is in forced contact with a core sealing surface 136 (see FIGS. 2 and 9). The portion of the core that fits inside the coils 108 may be cylindrical (except for a groove 134 (FIG. 10*a*), when a groove 134 is present). The core sealing surface 136 may be cylindrical (e.g., the groove 134, if present on part of the core, may be absent from the portion of the core that forms the sealing surface 136). The end plate sealing flange 119 may have the shape of a tapered conical lip, so that a pressure difference across the lip causes it to tighten against the cylindrical core sealing surface 136. In some embodiments the end plate sealing flange 119 is absent and the flow-restricting end plate 110 has one or two round holes that fit closely over the core sealing surface 136. In other embodiments the core sealing surface 136 is an annular end surface of a cylindrical portion having a larger diameter than the portion of the core that fits inside the coils 108, and an annular region surrounding each hole in the flow-restricting end plate 110 abuts against the core sealing surface 136 to form a seal. Small bypass flows past the core sealing surface 136 can be tolerated without loss of overall performance.

In the case of inductors or non-interleaved transformers, moderate to high stray B fields may pass through coils 108. This in turn may cause significant proximity eddy losses causing increased heat generation and reduced efficiency. These losses can be minimized by minimizing the thickness of the conductors used in coils 108—which in turn is achieved by maximizing the number of turns in each coil. The maximum number of turns may, however, be constrained by various design requirements. Conductor thicknesses can be further reduced where two or more conductors are co-wound as shown in FIGS. 10*a* and 10*b*. By individually connecting the conductors starts of one coil with starts of an opposing coil, circulating losses can be virtually eliminated, providing the interconnects are suitably transposed. (In the general case, where n layers are co-wound, an optimal transpose is provided where the jth layer of side A connects uniquely with the (n+1-j)th layer of side B.) The arrangement of FIGS. 10*a* and 10*b* meets this transpose requirement. The use of connection pins 126 to connect the inner ends of multiple co-wound conductors to corresponding co-wound conductors of an adjacent coil (e.g., to connect the inner ends 114*a*, 114*b* of two co-wound conductors to the corresponding inner ends of two co-wound conductors of an adjacent coil, as shown in FIGS. 10*a* and 10*b*) may facilitate assembly when co-wound conductors are used.

Figure 12A:
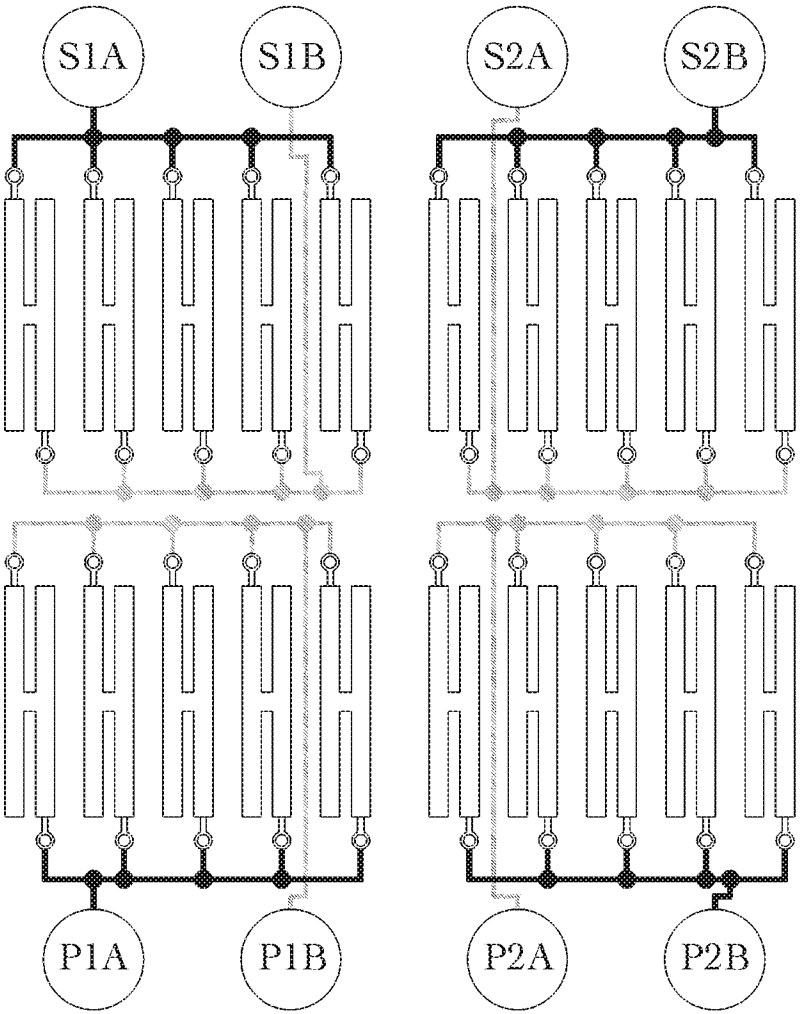
FIG. 12*a* is a schematic diagram showing a transformer having minimal interleave, according to an embodiment of the present invention.
Figure 12B:
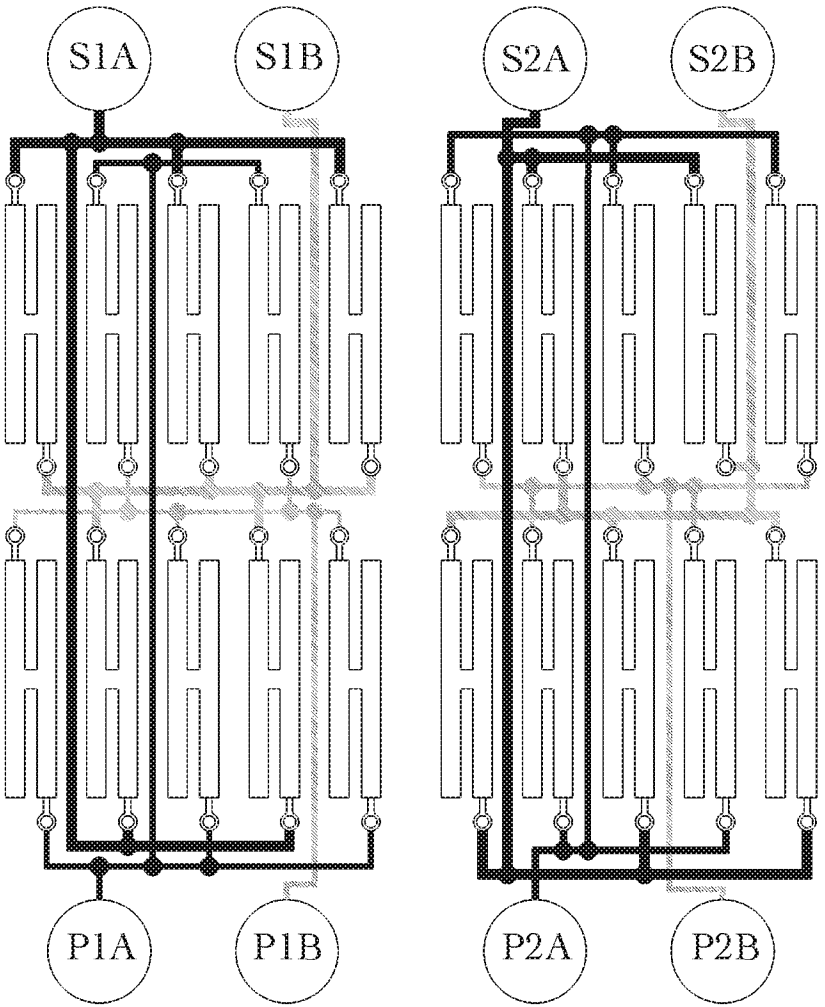
FIG. 12*b* is a schematic diagram showing a transformer having maximal interleave, according to an embodiment of the present invention.

As shown in FIGS. 1*a*-1*d*, 2, 3, and 11, winding leads 116 connect to terminal bus bars 142 and 144 which are part of terminal board 140. Terminal board 140 serves as an "interconnect" or a "circuit board" such that individual winding elements can be variously interconnected. Besides enabling various combinations of series and parallel connections, the terminal board 140 also enables various combinations of primary to secondary interleave as shown in FIGS. 12*a* and 12*b*. FIG. 12*a* shows the case of minimal interleave where primary windings are maximally separated form secondary windings. Conversely, FIG. 12*b* show the case where primary and secondary windings are maximally interleaved. As interleave is increased, winding leakage inductance and stray fields are both reduced.

Terminal bus bars 142 and 144 include terminal posts 146 which protrude through holes 164 located in the enclosure top 162; these terminal posts in turn serve to connect external power cables (see FIG. 11). O-rings 148 (see FIGS. 1*a*-1*d*, 2, 3, and 11) provide seals between terminal posts 146 and the inner surface of enclosure top 162. When enclosure top 162 is fully mated with enclosure bottom 172, O-rings 148 are under compression.

As shown in FIG. 3, terminal bus bars 142 and 144 are held in place by over-mold 141. Holes 147 located in terminal bus bars 142 and 144 serve to help lock these buses to the over-mold such that a rigid assembly is provided which can safely handle forces applied to terminal posts 146. Coil finish leads 116 connect to respective terminal bus bars 142 and 144. These connections may be made by soldering, welding, brazing, or crimping, for example.

The core may include a groove 134 such that space is provided for the connection, or "splice", between the coils of each pair of coils (see FIG. 10*a*), when the connection is made using connection pins 126.

In cases where the magnetic element is a transformer, U-cores and E-cores may be used; examples of core materials may include ferrite and high permeability powdered iron. In the case where the magnetic element is an inductor, examples of core materials may include low permeability powdered iron or high permeability core segments (e.g., core segments 131, illustrated in FIG. 10*a*) plus the inclusion of one or more air gaps. When air gaps are included, added winding losses may occur due to fringing magnetic flux which may pass through portions of coils 108. These problems can be minimized by using a relatively large number of core segments, such that a large number of core gaps is established—each of relatively small dimension. When this is carried out, core spacers 122 may be added to active spacers 104 (as shown in FIGS. 10*a* and 10*b*) and to passive spacers 106 and to feed plate 112. The thickness of core spacers 122 establishes a minimum spacing between core segments. Core spacers 122 are included only in the case where the core is composed of multiple segments and gaps are included between respective segments.

Figure 8A:
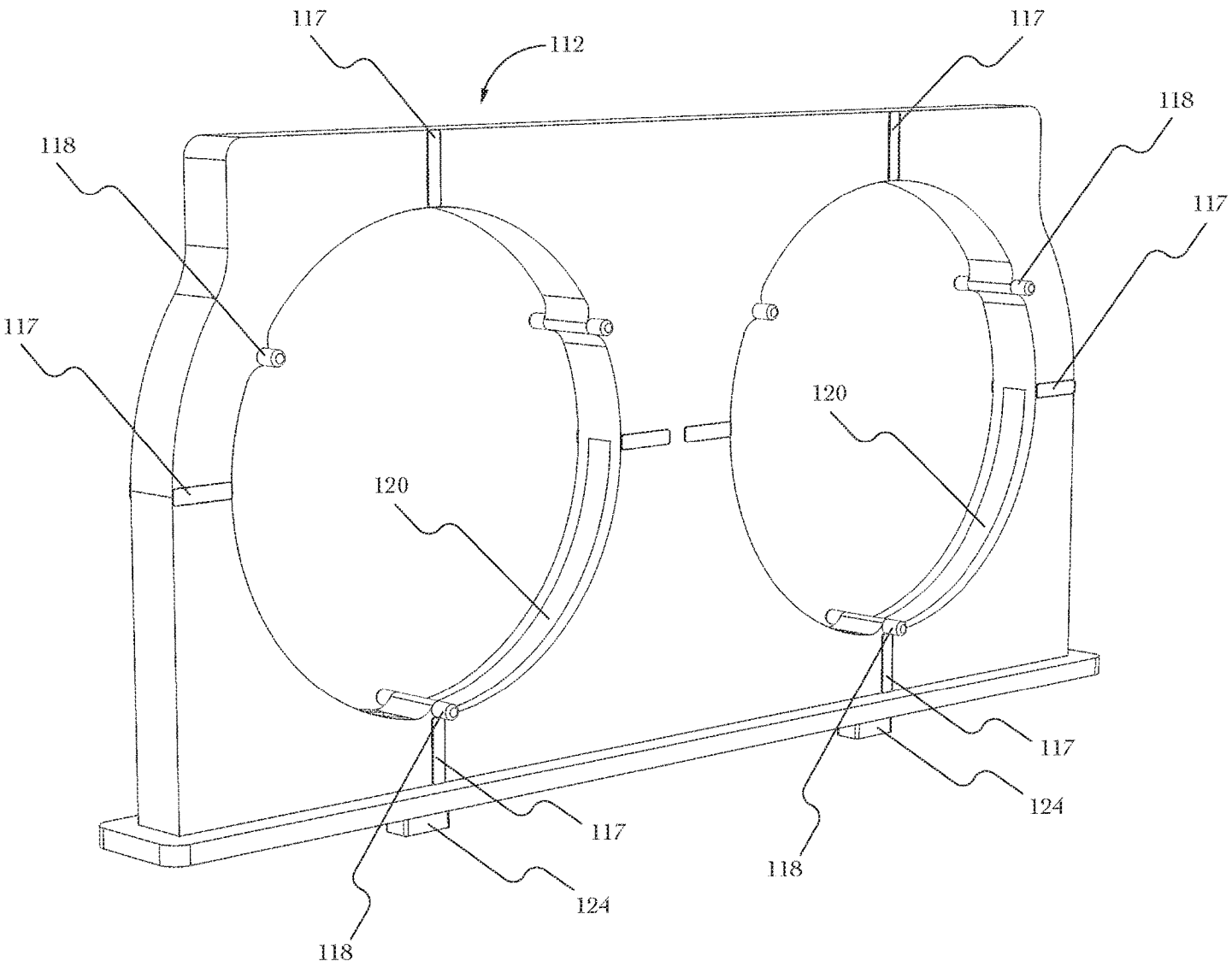
FIG. 8*a* is a perspective view of a feed plate of a magnetic assembly, according to an embodiment of the present invention.
Figure 8B:
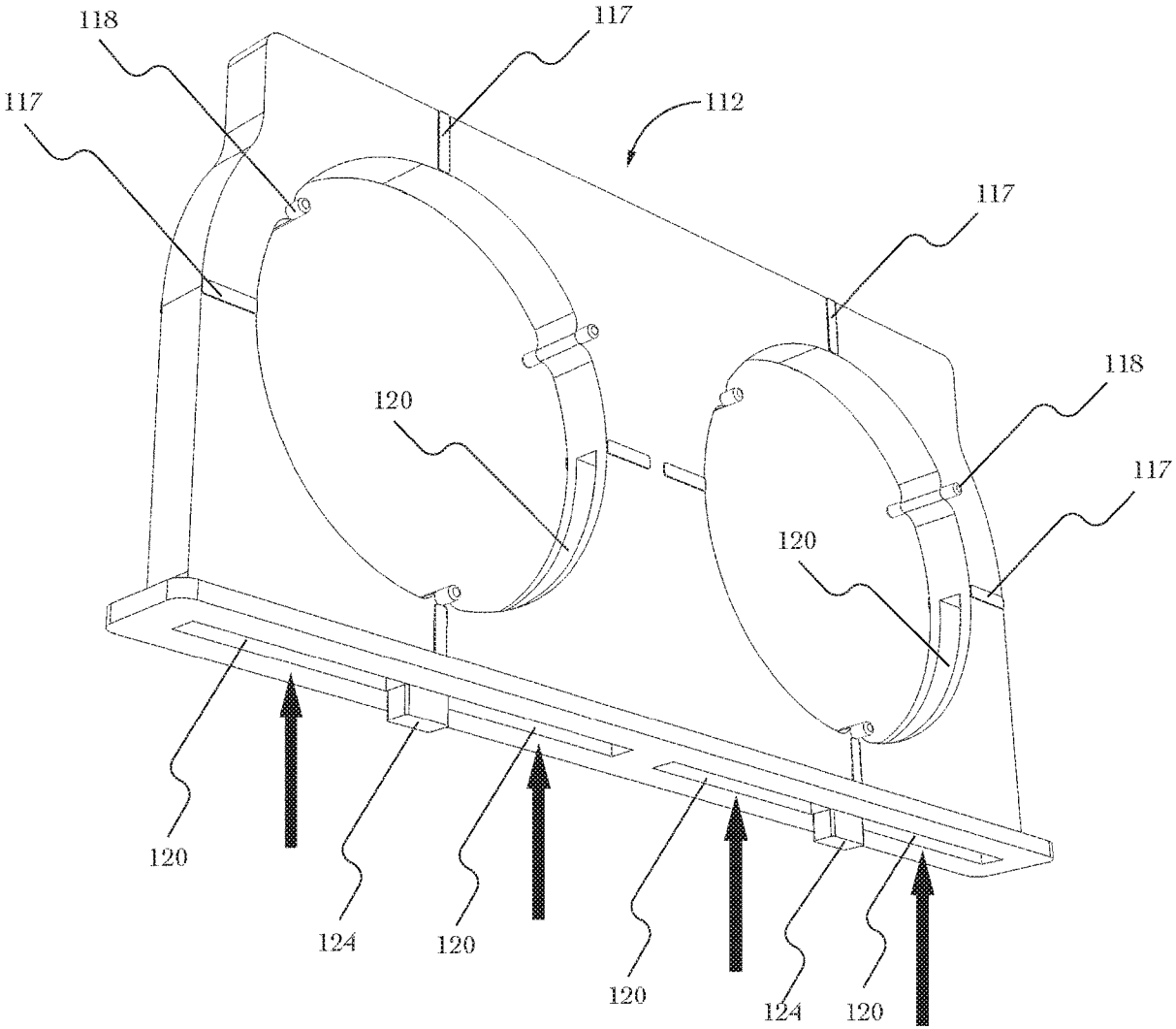
FIG. 8*b* is a perspective view of a feed plate of a magnetic assembly, according to an embodiment of the present invention.

Feed plate 112 may be located in the center of winding assembly 101. In some cases, feed plate 112 may be located at one end of the assembly, in which case it can also serve as an end plate. As shown in FIGS. 8*a* and 8*b*, feed plate 112 includes a cavity 120 forming a fluid passage between the two parallel faces of the feed plate 112, such that a coolant flow path is established between the bottom of the feed plate and annular region 127 between core 130 (or 131) and respective coils and spacers. In turn, cavity 120 aligns with inlet cavity 178 located within enclosure bottom 172 to receive coolant flow. In turn, cavity 178 is in fluid communication with fluid inlet 174 (see FIG. 11). Coolant flow which radially exits flow gaps 129 is contained within enclosure halves 162 and 172. Coolant exits the enclosure via outlet cavity 180 which is contiguous with fluid outlet 176 (see FIG. 11). Shims 190 (e.g., wedged shims) establish compression forces on core 130 (or on core 131 in the case of the embodiment of FIG. 2). Each of the shims 190 may be installed between the core 130 (or 131) and an interior surface 196 of the enclosure bottom 172. The feed plate 112 may include one or more indexing prongs 124 to maintain alignment between the feed plate 112 and cavity 178. A gasket 153 (FIG. 11) may fit into a register of the cavity 178 to form a seal between the feed plate 112 and the enclosure bottom 172, as illustrated in FIG. 11 and discussed in further detail below.

Referring further to FIG. 11, insulation barriers 166 are added to the outer surface of enclosure top 162 to enhance voltage withstand between terminal posts 146. A fluid seal between the two enclosure halves is achieved by O-ring 184 which is located in O-ring grove 182 located within enclosure bottom 172. The enclosure halves are drawn together by screws 170 in connection with top attachment lands 168 and bottom attachment lands 186. Mounting feet 188 may be integral elements of enclosure bottom 172. Enclosure halves may be fabricated as injection molded thermo-plastics or injection molded thermo-sets.

Figure 13:
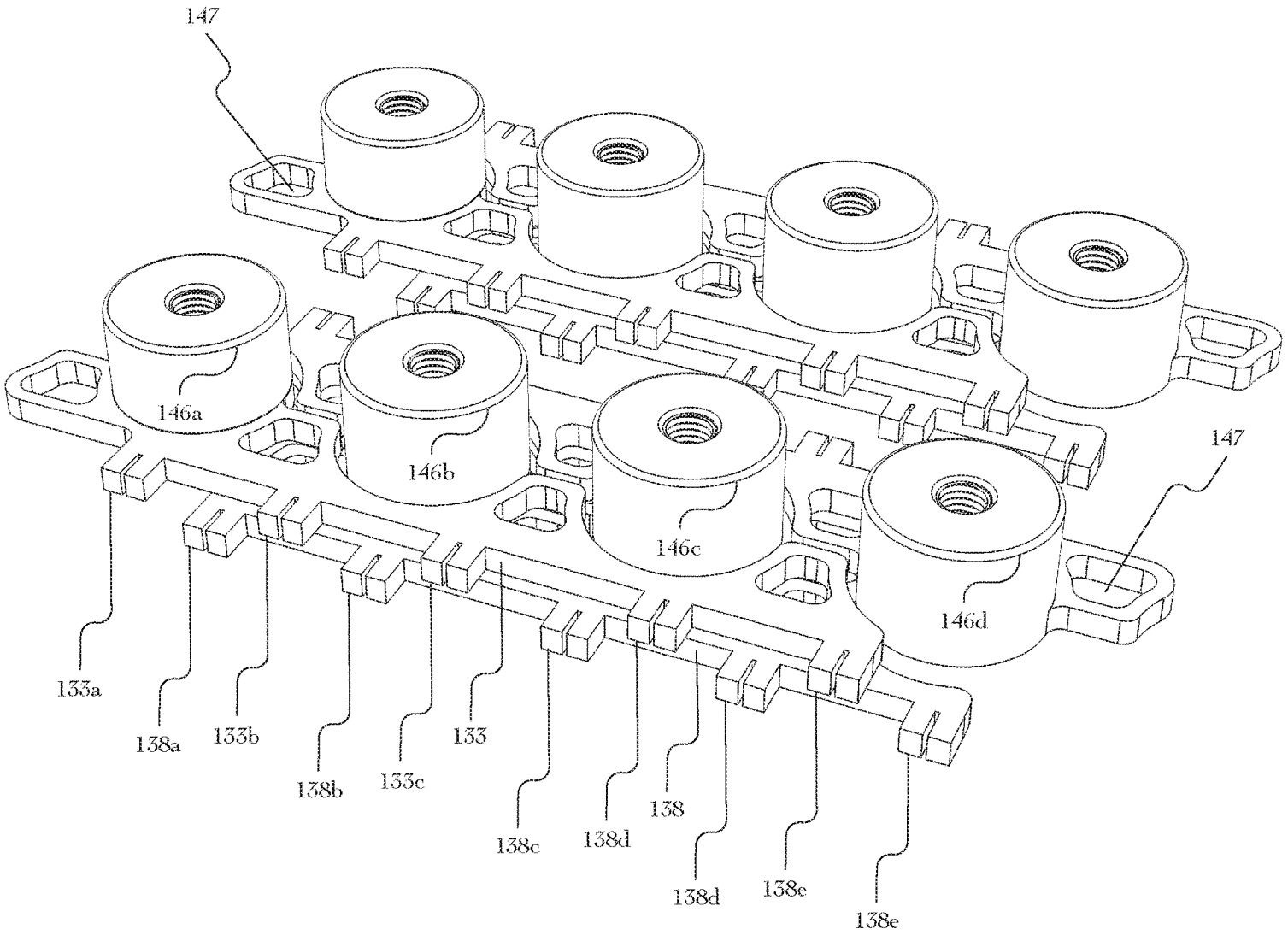
FIG. 13 is a perspective view of conductors of a terminal board, according to an embodiment of the present invention.

Referring to FIG. 13, in some embodiments, terminal board 140 comprises one or more layers each consisting of one or more mutually insulated conductors. In FIG. 13 a two layer terminal board is shown where the lower layer is composed of four conductive plates (one of which is a first lower conductive plate 138) and the upper layer is composed of four conductive plates (one of which is a first upper conductive plate 133). Each conductive plate is contiguous with a respective terminal post 146 (e.g., one of terminal posts 146*a*, 146*b*, 146*c*, 146*d*) such that complete electrical nodes are formed. Individual conductors (each including, e.g., a conductive plate and a terminal post) are mutually insulated and mechanically supported by an overmold 141 (e.g., a resin overmold; not shown in FIG. 13 but visible, e.g., in FIG. 1*c*, and identified in FIG. 3). Additional insulating elements may also be included to insure that electrical breakdown does not occur when high voltages are applied to the conductors. Each terminal post 146 may include a female thread as shown, or may include a threaded stud, such that lugged cables can be terminated. Each conductive layer has one or more lateral extensions which form winding end terminals 133 (which may, e.g., be solder terminals), or, e.g., terminal bus bars 142*a*, 142*b*, 144*a*, 144*b*, which extend out of the insulating overmold and which in turn connect to winding ends such that the desired terminal function is achieved.

The terminal board concept can have many variations. For example, any number of layers may be used; each layer may contain any number of conductors; individual layers may differ from each other; winding end terminal sizes or terminal post sizes may differ from each other; multiple terminals may be used for a single conductor; or winding end terminals 133 may be designed to accommodate welding.

The assembly may be cooled with a suitable fluid, which may be a liquid such as transformer oil, automatic transmission fluid or ethylene glycol, or which may be a gas, such as air. It will be understood that although some embodiments described herein are described for convenience with fluid flowing in a particular direction, e.g., from a fluid inlet, radially outward through flow gaps, and through a fluid outlet, in some embodiments the fluid flows in the opposite direction to similar or identical effect. As such, as used herein, when a fluid is described as flowing "between" a first volume and a second volume (e.g., between an inner volume and an outer volume of an element or structure) it means that the fluid flows from the first volume to the second volume or from the second volume to the first volume. Although some embodiments are described as including a ferromagnetic core, in some embodiments (corresponding to magnetic elements which may be referred to as "air-core" magnetic elements) such a ferromagnetic core may be absent, and, for example, the interior volume of any coil may be filled with cooling fluid.

As used herein, the word "or" is inclusive, so that, for example, "A or B" means any one of (i) A, (ii) B, and (iii) A and B. Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a fluid cooled magnetic element have been specifically described and illustrated herein, many modifications and variations will be apparent to those skilled in the art. Accordingly, it is to be understood that a fluid cooled magnetic element constructed according to principles of this disclosure may be embodied other than as specifically described herein. The invention is also defined in the following claims, and equivalents thereof.

What is claimed is:

1. A fluid-cooled magnetic element, comprising:

a first electrically conductive coil, having a first annular surface and a second annular surface;

a second electrically conductive coil having a first annular surface and a second annular surface;

a first spacer, the first spacer being electrically insulating and having a first face and a second face, the first face being separated from the first annular surface by a first gap;

a gap-setting feature between the first spacer and the first electrically conductive coil, configured to set a width of the first dap, a fluid inlet; and a fluid outlet, wherein:

a fluid path extends from the fluid inlet to the fluid outlet through the first gap, and the magnetic element is configured to cause fluid to flow through the first gap, in a direction having a radial component, between an inner volume of the first electrically conductive coil and an outer volume of the first electrically conductive coil.

2. The magnetic element of claim 1, wherein the first electrically conductive coil is a hollow cylindrical coil.

3. The magnetic element of claim 2, wherein:

the second electrically conductive coil is a hollow cylindrical coil, and the first annular surface of the second electrically conductive coil forms a second gap with the second face of the first spacer.

4. The magnetic element of claim 3, wherein the first electrically conductive coil has an outer end and an inner end, and the second electrically conductive coil has an outer end and an inner end connected to the inner end of the first electrically conductive coil, and wherein a contribution to a magnetic field at the center of the first electrically conductive coil, from a current flowing through both coils in series, is in the same direction as a contribution to the magnetic field from the current flowing through the second electrically conductive coil.

5. The magnetic element of claim 1, comprising a plurality of pairs of coils including the first electrically conductive coil and the second electrically conductive coil, wherein:

an inner end of one coil of each pair of coils is connected to an inner end of the other coil of each pair of coils, and the first spacer is a sheet.

6. The magnetic element of claim 5, comprising:

a plurality of active spacers including the first spacer; and a plurality of passive spacers, each of the active spacers having two faces and being between the two coils of a respective pair of coils, one coil of the pair of coils being on one of the faces, and the other coil of the pair of coils being on the other face, and each of the passive spacers being between a coil of one pair of coils and a coil of another pair of coils.

7. The magnetic element of claim 1, wherein the first spacer includes a cavity forming a fluid passage extending from outside the first spacer to an inner volume of the first spacer.

8. The magnetic element of claim 1, further comprising a plurality of core segments.

9. The magnetic element of claim 8, wherein a core segment, of the plurality of core segments, is ferromagnetic.

10. The magnetic element of claim 9, wherein the fluid path further extends through a third gap, the third gap being a radial gap between the core segment and the first electrically conductive coil or the first spacer.

11. The magnetic element of claim 1, wherein the first electrically conductive coil is a face-wound electrical conductor having a first inner end and a first outer end and the second electrically conductive coil is a face-wound electrical conductor having a first inner end and a first outer end.

12. The magnetic element of claim 11, comprising a plurality of coils including the first electrically conductive coil and the second electrically conductive coil, wherein:

the coils are stacked to form a cylinder, the respective winding orientations of the coils alternate along at least a portion of the cylinder such that the winding direction of adjacent coils is opposite; and a first inner end of each of the plurality of coils is connected to a first inner end of a respective adjacent coil of the plurality of coils.

13. The magnetic element of claim 1, comprising a plurality of gaps including the first gap, the magnetic element being configured to cause, in a condition of steady-state fluid flow, at least 50% of fluid received at the fluid inlet to flow to the fluid outlet through the gaps.

14. The magnetic element of claim 1, wherein the first gap has a width greater than 0.001 inches and less than 0.070 inches.

15. The magnetic element of claim 1, wherein the first electrically conductive coil is a composite coil including n co-wound conductors.

16. The magnetic element of claim 15 wherein:

the first electrically conductive coil has n inner ends the second electrically conductive coil is a composite coil including n co-wound conductors having n inner ends, and a $j^{th}$ inner end of the first electrically conductive coil is connected to an $(n-j+1)^{th}$ inner end of the second electrically conductive coil.

17. The magnetic element of claim 1, further comprising a third electrically conductive coil, the first electrically conductive coil, the second electrically conductive coil, and the third electrically conductive coil being connected together by a first monolithic conductor.

18. The magnetic element of claim 17, wherein:

a fourth electrically conductive coil is connected to a second monolithic conductor, and the first monolithic conductor is part of a first layer in a layered structure and the second monolithic conductor is part of a second layer in the layered structure.

19. The magnetic element of claim 1, comprising:

a plurality of coils including the first electrically conductive coil and the second electrically conductive coil; and a plurality of spacers including the spacer, the magnetic element having a plurality of gaps including the first gap, each of the gaps being between an annular surface of one of the coils and a face of a respective spacer, wherein the magnetic element is configured to receive fluid flowing into the fluid inlet and to cause at least 50% of the fluid to flow through the gaps and out through the fluid outlet.

20. The magnetic element of claim 1, wherein the gap-setting feature is a protrusion on:

the first face of the first spacer, or the first electrically conductive coil.

21. The magnetic element of claim 1, further comprising a housing configured to prevent the escape of fluid.

22. The fluid-cooled magnetic element of claim 1, further comprising:

a first terminal;

a second terminal; and a third terminal;

wherein:

the first electrically conductive coil has a first end connected to the first terminal and a second end connected to the second terminal; and the second electrically conductive coil has a first end connected to the third terminal.

* * * * *